US006938562B2

(12) United States Patent
Pope

(10) Patent No.: US 6,938,562 B2
(45) Date of Patent: Sep. 6, 2005

(54) APPARATUS FOR WASTE GASIFICATION

(75) Inventor: Michael G. Pope, North Ft. Myers, FL (US)

(73) Assignee: SenreQ, LLC, Oakbrook, IL (US)

( * ) Notice: Subject to any disclaimer, the term of this patent is extended or adjusted under 35 U.S.C. 154(b) by 0 days.

(21) Appl. No.: 10/632,043

(22) Filed: Jul. 31, 2003

(65) Prior Publication Data

US 2004/0031424 A1 Feb. 19, 2004

Related U.S. Application Data

(63) Continuation-in-part of application No. 10/439,398, filed on May 16, 2003, now abandoned.
(60) Provisional application No. 60/381,958, filed on May 17, 2002.

(51) Int. Cl.[7] ..... F23G 2/00; F23M 13/00
(52) U.S. Cl. ..... 110/229; 110/251; 110/305; 110/314; 110/315; 110/316
(58) Field of Search ..... 110/204, 205, 110/206, 207, 229, 251, 314, 305, 230, 231, 348, 315, 316; 48/197 R, 210, 86 R, 202, 203, 101, 111, 315; 122/7 R

(56) References Cited

U.S. PATENT DOCUMENTS

| | | | | |
|---|---|---|---|---|
| 624,388 A | | 5/1899 | Siemens | |
| 685,539 A | | 10/1901 | Swindell | |
| 2,395,091 A | * | 2/1946 | Barnes | 110/205 |
| 2,808,012 A | | 10/1957 | Schindler | |

(Continued)

FOREIGN PATENT DOCUMENTS

| | | |
|---|---|---|
| DE | 2432504 A1 | 1/1976 |
| DE | 2639165 A1 | 3/1978 |
| DE | 4030743 A1 | 4/1992 |
| EP | 0173628 A2 | 3/1986 |
| WO | WO-93/08242 | 4/1993 |

OTHER PUBLICATIONS

Walter R. Niessen, et al., Evaluation of Gasification and Novel Thermal Process for the Treatment of Municipal Solid Waste, NREL, Aug. 1996, 1–1–9–6, NREL/TP–430–21612, National Renewable Energy Laboratory, Golden, Co, USA.

*Primary Examiner*—Kenneth Rinehart
(74) *Attorney, Agent, or Firm*—McAndrews, Held & Malloy, Ltd.

(57) ABSTRACT

A gasification system that includes a gasification reactor chamber having perforated conduits or an inner lining that increases the exposed surface area of waste materials to gasification conditions, thereby decreasing gasification temperature, time, and cooling period between subsequent gasification procedures. After an aspirator withdraws and oxidizes fuel gas from the gasification reactor chamber, a flare assembly combusts the mixed fuel gas to provide power or heat to at least one heat recovery device. The at least one heat recovery device recaptures thermal energy entrained in the exhaust, thereby reducing exhaust temperature and eliminating the need for an exhaust stack. An absorber purifies the exhaust and an extractor removes carbon dioxide. A portion of the removed carbon dioxide may be used for industrial purposes or for supporting vegetation. At least a portion of the remaining exhaust is returned to the gasification reactor chamber as recycled process gas, thereby completing a closed-loop system.

11 Claims, 15 Drawing Sheets

U.S. PATENT DOCUMENTS 3,961,587 A * 6/1976 Ozawa ..... 110/216
4,145,979 A 3/1979 Lilley et al.
4,295,331 A 10/1981 Rekant
4,305,732 A 12/1981 Koenig et al.
4,306,506 A * 12/1981 Rotter ..... 110/229
4,378,745 A 4/1983 Flatland
4,398,475 A 8/1983 McKiel, Jr.
4,448,588 A 5/1984 Cheng
4,878,440 A 11/1989 Tratz et al.
4,941,415 A 7/1990 Pope et al.
5,026,403 A * 6/1991 Michel-Kim ..... 48/203
5,156,097 A * 10/1992 Booth et al. ..... 110/214
5,159,899 A 11/1992 Dobrzynski
5,222,446 A 6/1993 Edwards et al.
5,279,234 A 1/1994 Bender et al.
5,313,894 A 5/1994 Ishikawa
5,425,317 A 6/1995 Schaub et al.
5,569,312 A 10/1996 Quirk et al.
5,573,568 A 11/1996 Quirk et al.
5,619,938 A 4/1997 Kaneko
5,711,232 A 1/1998 Yamaguro et al.
5,741,465 A 4/1998 Gregg
5,823,122 A 10/1998 Chronowski et al.
5,881,654 A 3/1999 Fleming et al.
6,439,135 B1 8/2002 Pope

* cited by examiner

=GAS FLOW
100
TRUCK LOADING AREA
WASTE GASIFIER #1 85 TON CAPACITY
WASTE GASIFIER #2 85 TON CAPACITY
WASTE GASIFIER #3 85 TON CAPACITY
101
102
103
229A
229B
229C
107
108
109
210A
210B
210C
211
212
118
RETURN AIR-LINE TO WASTE GASIFIER CELLS
148
AMINE SOLVENT
$CO_2$ DELIVERY SYSTEM
116
$CO_2$ LINE
GREEN HOUSE
115
ABSORBER
317
INDUCED DRAFT FAN
GEO-THERMAL FIELD OUT TAKE
GEO-THERMAL FIELD INTAKE
GEO-THERMAL TUBE FIELD
$CO_2$ DELIVERY SYSTEM
GREEN HOUSE
113
117

101
LOAD ACCESS
127
14'
120
36'
125
"Z" CONVEYOR
8'
321

101
LOAD ACCESS
120
14'
225
ASPIRATOR
36'
30'
125
119
3'
6'
"Z" CONVEYOR
321

101
120
14'
225
125
36'
30'
321
6'
8'

APPARATUS FOR WASTE GASIFICATION

CROSS REFERENCE TO RELATED APPLICATIONS

This application is a continuation-in-part of U.S. patent application Ser. No. 10/439,398 filed on May 16, 2003 now abandoned, which claims the benefit of U.S. Provisional Application No. 60/381,958, filed May 17, 2002, both of which are incorporated herein by reference in their entirety.

BACKGROUND OF THE INVENTION

Many attempts have been made at creating waste disposal systems that eliminate or reduce the need to landfill municipal solid waste ("MSW"). Traditional approaches have included incineration and pyrolisis. Conventional incineration however is objectionable because the high burn temperatures in the presence of oxygen results in the formation of complex pollutants that are difficult and expensive to control. Furthermore, the vast majority of incinerated organic material is converted into undesirable carbon dioxide, which is implicated in global warming, ozone layer depletion, and the formation of volatile organic compounds. The incineration process also releases nitrogen oxides that contribute to smog problems in urban areas. The pyrolisis procedure involves the conversion of various materials into a glass like residue in an oxygen depleted, high temperature environment. However, the high temperature, depleted oxygen environment of pyrolisis creates some extremely toxic compounds. Furthermore, pyrolisis is an inefficient method for disposing large volumes of waste materials, and the residual ash material contains large amounts of carbon.

Many of the disadvantages of incineration and pyrolisis are overcome by waste gasification. Waste gasification involves supplying the minimum amount of oxygen necessary to cause a thermo-chemical reaction that releases simple combustible gases at a controlled temperature, without supplying enough oxygen to cause combustion. When feed stock materials, such as MSW, that are rich in energy as measured by British thermal units, are loaded into gasification reactor chambers, and are exposed to a controlled temperature, oxygen depleted environment, such solid, sludge, or liquid feed stock materials are converted into a heavy vapor gas fuel. Materials that are rich in energy include, but are not limited to, coal, wood, cardboard, paper, industrial scrap, plastics, tires, organic wastes, sewage cake, animal waste, and crop residue, or a combination thereof. The released heavy vapor fuel gas is then mixed with oxygen and burned. Examples of prior gasification systems are shown in U.S. Pat. No. 4,941,415, which is incorporated herein by reference, and U.S. Pat. No. 5,941,184.

The material remaining after the completion of the gasification process cycle is composed of incombustible materials, including metals, glass, and ceramics, along with a fine inert salt and mineral power residue, and has a greatly reduced volume that is suitable for remanufacturing into concrete material or land filling. Furthermore, recyclable materials that do not undergo phase transition, such as all recycle glass, aluminum, metals, residual materials and salts, are recoverable after the gasification process, thereby eliminating the need for pre-sorting or processing the in-bound feed stock material.

Conventional prior art gasification systems are multi-step processes that generally utilize four open-looped process steps. These four steps typically involve: one or more primary gasifiers; a central air mixing chamber; a secondary processor for combusting the produced heavy vapor gas fuel; and final air cleaning systems. However, conventional gasification systems have proved difficult to cost-effectively construct. Therefore, a need exists for a simplified gasification apparatus that is inexpensive to build, simple to operate, and yet achieves the benefits of producing a gas fuel from solid waste feed stock materials.

Furthermore, prior art open-looped systems, such as U.S. Pat. No. 6,439,135, which is incorporated herein by reference, utilize exhaust stacks that release hot gases from the final combustion step into the atmosphere, or use storage tanks to collect the hot gases for future ancillary purposes, rather than reclaiming at least a portion of the cleaned air for re-introduction into the gasification process. Furthermore, such prior art systems do not teach a gasification system that produces a relatively pure carbon dioxide for other industrial purposes or to support the augmentation of vegetation, such as a greenhouse, a carbon dioxide dispersal system, or an aquaculture bed.

Current research indicates that increasing the surface area of the feed stock material that is exposed to gasification process gas significantly improves the production rate of fuel gas from the feed stock materials. Yet, prior art gasification systems, such as those illustrated in U.S. Pat. Nos. 6,439,135 and 5,619,938, utilize gasification reactor chamber configurations that expose only limited feed stock surface area to gasification process gas. Such prior art systems incorporate gasification reactor chamber configurations where only the bottom of the feed stock at grate level, known as the primary reaction zone, and the uppermost surface of the feed stock, known as the secondary reaction zone, are exposed to optimum gasification conditions.

As a result, gasification of the tons of feed stock material that is not located at either the primary or secondary zones, such as that on the sides and center of the gasification reactor chamber, requires that the temperature and duration of the gasification cycle be increased. Yet, higher gasification temperatures tend to reduce the Btu content of the resulting heavy vapor fuel gas. The high operating temperatures also increase the time required for cooling the gasification reactor chamber to a temperature suitable for the loading and disposal of subsequent loads of feed stock materials.

Furthermore, the costs associated with obtaining and maintaining the higher gasification temperatures, along with the cost of fabricating a complex gasification reactor chamber that can withstand prolonged exposure to high temperatures, also increase. Current gasification reactor chambers are lined with various clay-based insulative/refractory materials. These refractory materials maintain gasification reactor temperatures while also preventing structural damage to the gasification reactor chamber's steel superstructure and surface paint associated with prolonged exposure to excessive heat. Refractory material is usually applied to the gasification reactor chamber as pre-cast panels, bricks, or sprayed on as a gunnite-like application. Such refractory material is affixed to the exterior steel jacket of the gasification reactor chamber by refractory hangers, which are heavy metal dowels in the form of hooks. With typical prior art systems, a two to four inch layer of ceramic fiber blanket is usually inserted between the refractory material and the steel jacket before the refractory layer is installed to offer additional thermal protection for the exterior steel surfaces of the gasification reactor chamber.

Application of refractory material is thus labor intensive, time consuming, and a significantly expensive step. Additionally, the weight of the refractory liner necessitates that the steel vessel be constructed from at least ¼ inch thick hot rolled A36 steel plate and heavy structurals. This additional superstructure weight further increases the overall cost of manufacturing, shipping, and installation.

An additional problem with the use of refractory material is the length of time required for cooling the gasification reactor chamber before it can be re-used to gasify a subsequent load of MSW. More specifically, a subsequent gasification process typically cannot begin until the gasification reactor chamber has cooled to approximately 150 degrees Fahrenheit. Yet, at the end of a process cycle, the clay refractory material tends to retain heat for a long period of time. Depending on the particular chemistry of the refractory material, this retention of heat may require that the gasification reactor chamber be inoperative for several hours as the temperature of the chamber, and associated refractory material, cools down.

The limited feed stock capacity of prior art gasification systems often required the construction of multiple gasification reactor chambers to meet demand requirements. In previous designs, gasification reactor chambers typically have a rectangular configuration. As the length of the rectangular sidewalls is increased to satisfy larger feed stock capacity requirements, the size of the gasification reactor chamber creates problems associated with providing sufficient clearance space away from the prolonged high temperatures of the gasification reactor chamber. This problem typically limits gasification reactor chambers to configurations that are approximately 20 feet high, 20 feet wide, and 20 feet long. Such a configuration however has a limited load capacity of approximately 50 tons of feed stock material. Furthermore, as the size of the rectangular configuration is increased, problems develop with the side load waste dump arrangement. More specifically, as the rectangular sidewalls extend beyond 20 feet, the angle of repose of the trash spilling out of the garbage truck typically only fills a small portion of the gasification reactor chamber's near sidewall.

Because the heavy vapor fuel gas has been produced in an environment that typically contains no more than 8% oxygen, waste gasification systems must also increase the level of ambient oxygen in the gas produced in the gasification reactor chamber to make it fully flammable. This often requires increasing the oxygen content of the heavy vapor fuel gas to approximately 15% to 20%.

Prior art gasification systems increased the oxygen content of the heavy vapor fuel gas by directing the heavy vapor fuel gas through air mixing chambers. These mixing chambers are typically large, cylindrical vessels, with a variety of air induction tubes attached to multiple blower fans that flood the air mixing chambers with outside air using air compressors or high velocity fans. Yet, because of the large size of these chambers, they require substantial fabrication and installation time, and as a result are expensive. The use of fans and/or air compressors also increases the initial cost of the system and operating and maintenance expenses.

Conventional gasification systems also use cumbersome techniques for moving fuel gas to the point of combustion. Such systems often vent, or breech, the fuel gas from the top or at least one side of the gasification reactor chamber, and direct the vented fuel gas from the gasification reactor chamber into a secondary gas processor, which is usually driven by a natural draft current that is created by hot air in the system rising through an exhaust stack. The fuel gas' exit from the gasification reactor chamber is controlled by a motor driven damper assembly that regulates the varying flow of produced fuel gas from this first process step into ducting that connects the gasification reactor chamber to the secondary air mixing chamber. Such systems typically require large diameter piping to draw the gas off from the gasification reactor chamber. This large piping, and associated ductwork, increases not only equipment cost, but also installation expenses.

A further disadvantage of traditional air draft systems is that heavy vapor fuel gases have a tendency to linger in the gasification reactor chamber, and become subject to accidental combustion, which ultimately lowers the Btu content of the extracted heavy vapor fuel gas. This problem is exacerbated by the inconsistency of up-draft air movement in a natural draft system. Humidity, wind, barometric pressure and outside temperature all affect the rate of flow through a natural draft system. This inconsistent flow causes the evacuation of gases from the gasification reactor chambers to frequently stall, produces negative results in the process, and adversely effects the total cycle time for the gasification of the feed stock material.

Furthermore, the combustion of the heavy vapor fuel gas in a hot water heater, steam boiler, refrigeration unit, or other industrial process, produces a relatively high temperature exhaust. Yet, prior art systems often vent this hot combusted exhaust into the atmosphere at a temperature between 1200 and 1600 degrees Fahrenheit, thereby wasting a significant thermal resource that could be further captured and directly utilized in other heat dependent applications, thereby preserving natural resources and providing a cost efficient source for heated gas.

Hot combusted exhaust that is vented into the atmosphere in prior art systems via an exhaust stack also often contain large quantities of carbon dioxide. While carbon dioxide is not currently regulated as a pollutant from solid waste incinerators, it is subject to various industrial air quality abatement initiatives.

Furthermore, by recapturing the thermal energy that is entrained in the exhaust for additional attached applications, and thereby continuing to reduce the ultimate exhaust temperature of the exhaust gas, the volume of the exhaust decreases. As the volume of the exhaust gas is reduced, the size and quantity of conveying piping and other gas handling equipment, along with associated equipment costs, also decrease.

It is therefore an object of the present invention to provide a gasification system capable of gasifying feed stock at a reduced temperature and time.

It is another object of the present invention to decrease the time between subsequent uses of the gasification reactor chamber.

It is a further object of the present invention to provide a gasification system that produces a high Btu content vapor gas.

It is another object of the present invention to provide an inexpensive to build, simple to operate, gasification system that provides the benefits of producing a fuel gas from feed stock material.

It is another object of the present invention to provide for improved gas collection that allows for both simpler gasification reactor chamber configurations and an improved gas flow design that allows for better final combustion.

It is another object of the present invention to provide a gasification system that eliminates the need to rely on multiple gasification reactor chambers to provide an increased system volume capacity.

It is a further objective of the present invention to capture and sequester carbon dioxide produced by the gasification system, and to use the sequestered carbon dioxide in a beneficial manner.

It is another objective of the present invention to improve the quality of the final exhaust air from the present invention sufficiently to re-introduce the recycled process gas into the gasification system, thereby creating a closed-loop system.

These and other desirable characteristics of the present invention will become apparent in view of the present specification, including the claims and drawings.

BRIEF SUMMARY OF THE INVENTION

The present invention is directed to a system for the gasification of a variety of waste streams, including, but not limited to, agricultural, industrial, and municipal waste streams. More particularly, the invention relates to a gasification system that incorporates a self sustaining gasification reactor chamber that has its own dedicated flare assembly, and which is capable of gasifying large volumes of feed stock material without the need for multiple gasification reactor chambers. This self-sustaining gasification reactor chamber and flare assembly are also capable of being used with other self-sustaining chambers to feed at least one common heat recovery device. Furthermore, the present invention is a closed-loop system, which eliminates the need for an exhaust stack, and which recovers heat entrained in hot exhaust, thereby producing a cooled exhaust that is subsequently filtered and separated from carbon dioxide, and which is suitable for re-introduction into the gasification procedure. Removed carbon dioxide may then be used for other industrial operations, or may be used to support the augmentation of vegetation, such as a greenhouse or a carbon dioxide dispersal system, whereby vegetation converts the carbon dioxide into oxygen that may also be recaptured for re-introduction into the system of the present invention.

In one embodiment of the present invention, the gasification system is comprised of a gasification reactor chamber, an aspirator, a flare assembly, at least one heat recovery device, an absorber, and an extractor.

MSW is loaded into the gasification reactor chamber for gasification, whereby the MSW serves as feed stock material. The gasification reactor chamber is comprised of an interior chamber and an outer shell. Although the gasification reactor chamber of the present invention may have a number of shapes, including being rectangular, square, or cylindrical, the gasification reactor chamber of the preferred embodiment of the present invention has at least five sidewalls and includes perforated conduits and/or an inner liner. The perforate conduits or inner liner increase the surface area of feed stock material that is exposed to optimum gasification conditions, thereby decreasing both the gasification cycle time and temperature, while also decreasing the time between additional gasification procedures on subsequently loaded feed stock material. The reduction in gasification temperature also allows for the fabrication of the gasification reactor chamber from lighter gage material, and eliminates the need for refractory material, thereby reducing the weight of the gasification system and the time and expense associated with its fabrication. Furthermore, gasification conditions may be controlled by a process logic controller, which is used to control the gas content and temperature in the interior chamber.

An aspirator assembly, through the use of a motor, is used to create a negative pressure in the interior chamber, thereby allowing for the smooth and even evacuation of heavy fuel vapor gas. As the motor blows ambient air into a conduit coupling, a suction force is created in the conduit coupling, the attached single gas manifold, and the gas siphon assembly. This suction force pulls the heavy vapor fuel gas from the interior chamber and into the conduit coupling. The efficient extraction of heavy vapor fuel gas afforded by the aspirator assembly also prevents the occurrence of accidental combustion that may lower the Btu content of the desired fuel gas.

The ambient air used by the aspirator to create the suction force is mixed with the heavy vapor fuel gas in the conduit coupling, thereby eliminating the need for a separate mixing chamber. Furthermore, control of the motor and the selected size of the tubing and conduit allow for finite control of the volume of gas that moves through, and is mixed by, the aspirator assembly. The aspirator assembly of the present invention also eliminates the need for a damper.

Mixed gas exiting the aspirator then enters a flare assembly. In the preferred embodiment of the invention, the flare assembly includes a targeting nozzle that has a conical funnel configuration. The configuration of the targeting nozzle allows for additional mixing of the gases, increases the velocity of the mixed gas so as to provide back pressure in the system, and creates a focus point for combustion. Back pressure created by the conical funnel configuration not only aids in the smooth operation of the at least one common heat recovery device, but also allows the system to incorporate heat recovery devices that have minimum positive input pressure requirements.

In the preferred embodiment of the present invention, the flare assembly is built in, or is a sub-component of, at least one primary heat recovery device. The combustion of the mixed gas by the flare assembly is then used to operate or heat the at least one heat recovery device. Alternatively, hot combusted gas is delivered from the flare assembly to the at least one common heat recovery device. In instances in which more than one common heat recovery device is used, each subsequent heat recovery device further captures the thermal energy that is entrained in the exhaust until the temperature of the exhaust has been reduced to a permissible level for filtering in an absorber. Heat recovery devices include, but are not limited to, boilers, generators, and reverse chiller refrigeration loops.

In an alternative embodiment, the hot exhaust exiting the at least one heat recovery device may also pass through a geothermal field, in which the exhaust is directed to a subsurface manifold that may be located underground or beneath a body of water. Heat from the exhaust is then used to heat the surrounding ground or water, and may provide a no-operating cost method for heating such things as on-site greenhouses and aquaculture beds.

In another embodiment of the present invention, exhaust from the last heat recovery device is diverted into a chilling loop. In the preferred embodiment, the exhaust entering the chilling loop has a temperature of approximately 300 degrees Fahrenheit. The cold chill tubes cause the temperature of the through-flowing exhaust air to cool and the moisture to condense. The condensation removes virtually all particulate matter, particularly water-soluble particulate matter, including HCl and $SO_2$, from the exhaust air stream. The water is then removed in a knock-out trap Once the exhaust temperature has been reduced to meet the intake requirements of an absorber, such as a monolithic lime absorber, the exhaust gas is filtered for low temperature criteria pollutants, such as, but not limited to, HCl. The filtered exhaust then proceeds to an extractor where carbon dioxide is separated from the remaining filtered exhaust, which is comprised mainly of oxygen and water vapor. The oxygen and water vapor may then be re-directed back to the gasification reactor chamber as recycled process gas for re-use in the gasification system, thus providing a closed-loop process.

Carbon dioxide may be captured for other industrial purposes, or may be vented for the purpose of facilitating the growth of on-site vegetation, such as a greenhouse. Careful planning in the selection of plants may create an on-site vegetative environment that is capable of converting all of the produced carbon dioxide into oxygen. The converted oxygen may then be captured for re-introduction in the gasification system of the present invention.

BRIEF DESCRIPTION OF SEVERAL VIEWS OF THE DRAWINGS

For a more complete understanding of this invention reference should now be had to the embodiment illustrated in greater detail in the accompanying drawings and described below by way of example of the invention.

DETAILED DESCRIPTION OF THE INVENTION

Overview

Figure 1:
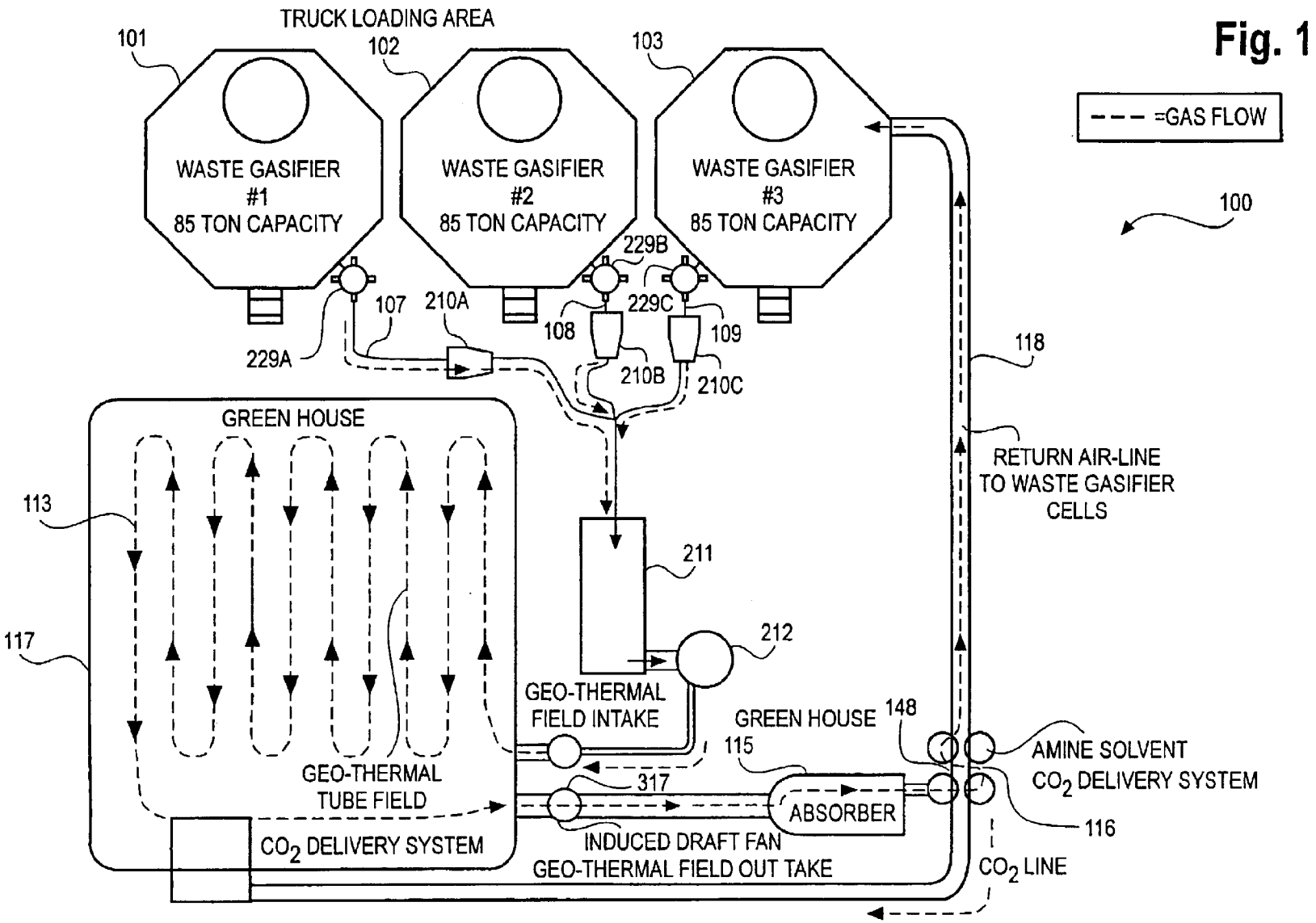
FIG. 1 shows a process diagram for a multi-cell gasification system in accordance with the present invention.
Figure 9:
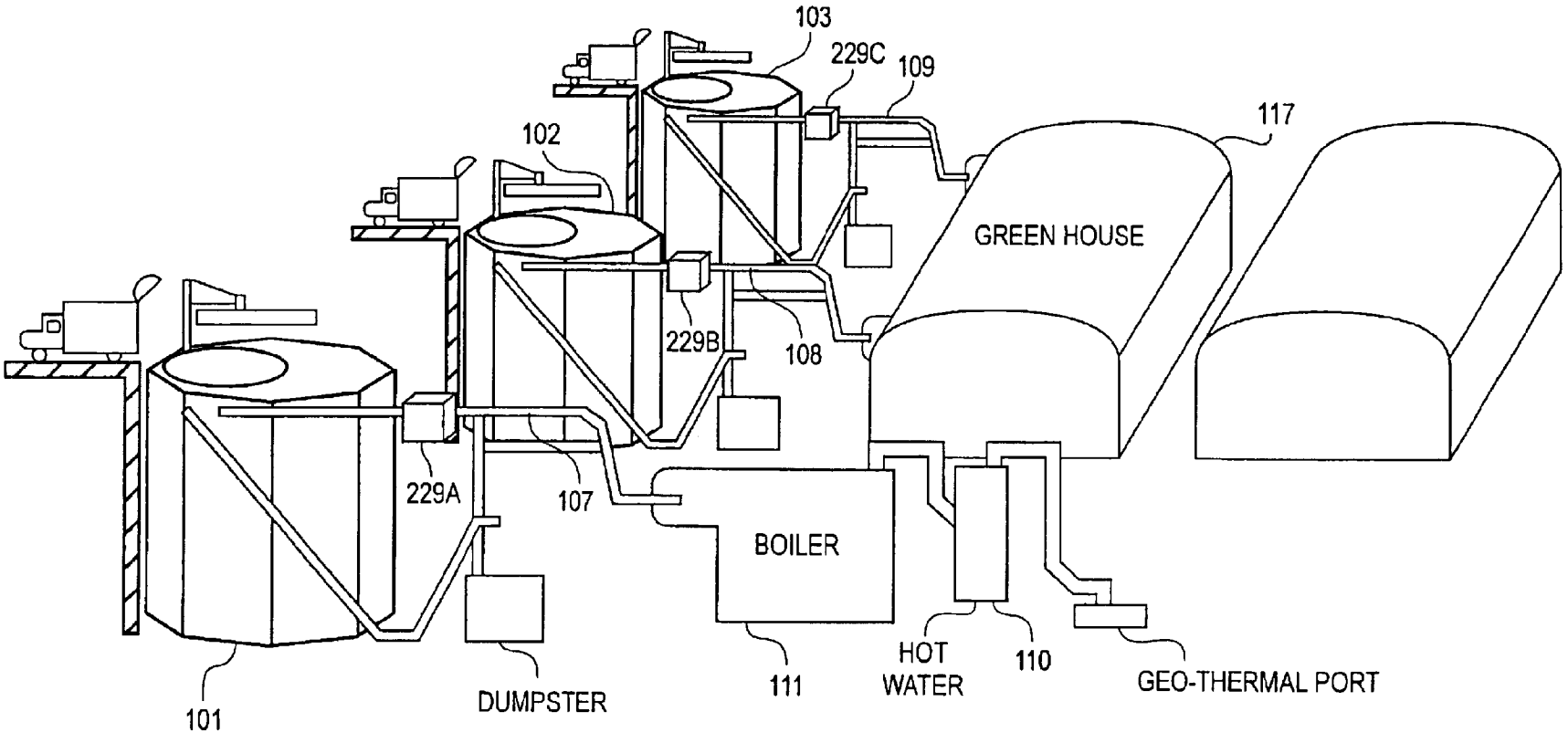
FIG. 9 shows a general operational layout of the present invention.
Figure 10:
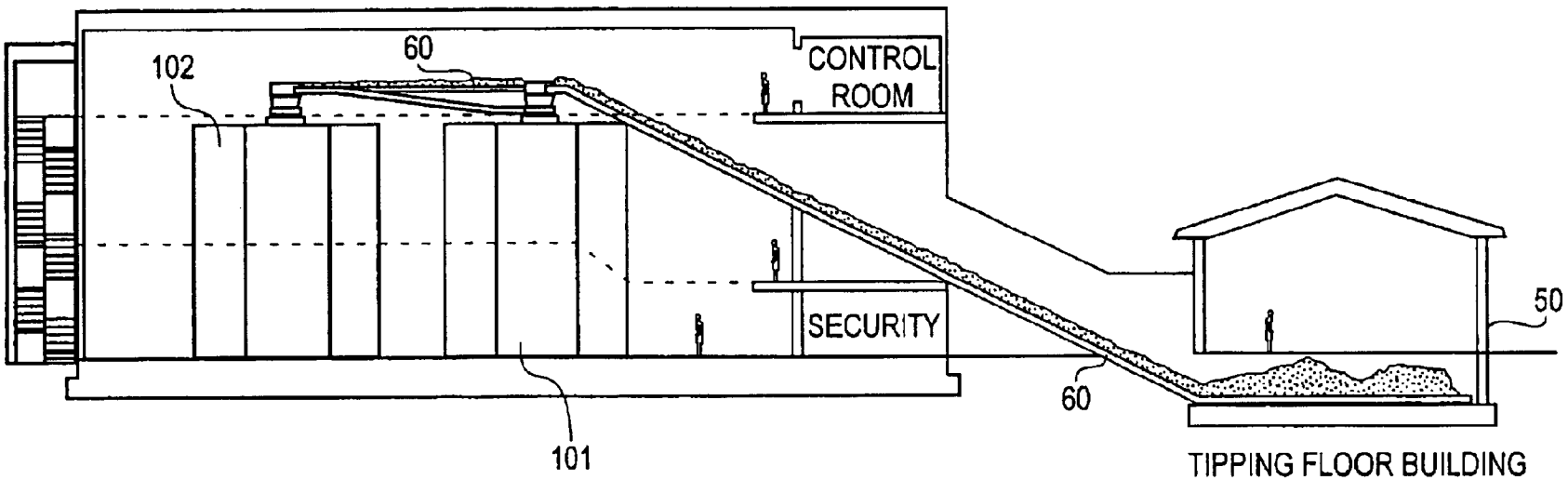
FIG. 10 shows an overview of transporting feed stock material to multiple waste gasification reactor chambers in accordance with the present invention.

The complete system of the present invention can be understood by referring to FIG. 1, which shows a closed-loop waste gasification system 100. Waste hauling trucks unload feed stock material either directly into batch waste gasification reactor chambers 101, 102, 103, as shown in FIG. 9, or unload the feed stock at a tipping floor area 50, as shown by FIG. 10, whereby a variety of conveyors 60 transport the feed stock to the gasification reactor chambers 101, 102. Once in the gasification reactor chambers 101, 102, 103, the feed stock material undergoes gasification. As shown in FIG. 1, uncombusted heavy vapor fuel gas driven off in the gasification reactor chambers 101, 102, 103 is evacuated by aspirator assemblies 229*a*, 229*b*, 229*c* through collection ducts 107, 108, 109 to the dedicated flare assemblies 210*a*, 210*b*, 210*c*.

Radiant and convection heat generated in the flare assemblies 210*a*, 210*b*, 210*c* converge, and are absorbed by at least one heat recovery device, such as a primary heat recovery device 211, which may include, but is not limited to, a steam boiler, heat exchanger, or any other heat sink. Each flare assembly 229*a*, 229*b*, 229*c* may be operably connected to both a single self-sustaining gasification reactor chamber 101, 102, 103 and to the primary heat exchanger 211, as illustrated in FIG. 1, whereby the flare assemblies 229*a*, 229*b*, 229*c* produce a hot combusted exhaust that is fed into a primary heat recovery device 211.

As shown in FIG. 9, in the preferred embodiment of the present invention, the gasification reactor chambers 101, 102, 103 and their dedicated flare assemblies (not shown), the flare assemblies being similar to the flare assemblies 210*a*, 210*b*, 210*c* illustrated in FIG. 1, are operably connected to different primary heat recovery devices. As illustrated, one gasification reactor chamber 101 provides heavy vapor fuel gas for operating a boiler 111 and hot water heater 110, while other gasification reactor chambers 102, 103 independently supply heavy vapor fuel gas to support the operations of a greenhouse 117. Each associated flare assembly then independently satisfies its combustion requirements for the attached heat recovery device. Alternatively, as shown in FIG. 1, the multiple flare assemblies 210*a*, 210*b*, 210*c* may also be operably connected to a common primary heat recovery device 211, whereby each individual flare assembly 210*a*, 210*b*, 210*c* independently combusts heavy vapor fuel gas from its dedicated gasification reactor chamber 101, 102, 103 in accordance with the designed combustion requirements of the common primary heat recovery device 211. Furthermore, although FIG. 1 illustrates the flare assemblies 210*a*, 210*b*, 210*c* as separate components that are not part of the primary heat recovery device 211, each flare assembly 210*a*, 210*b*, 210*c* may also be built into, or a subcomponent of, the system's 100 primary heat recovery device 211, whereby rather than receiving thermal energy in the form of hot combusted gas, the combustion of heavy vapor fuel gas is directly used to power or operate the primary heat recovery device 211.

Additional heat recovery devices, such as a secondary heat recovery device 212 may also use exhaust from the primary heat recovery device 211. In one embodiment of the invention, the secondary heat recovery device 212 is a reverse chiller refrigeration system, the reverse chiller system being comprised of an inlet, a radiator, an induced draft fan, a sump, and an outlet. Hot exhaust is pumped into the radiator from the primary heat recovery device 211, the momentum for the hot exhaust being provided by the in-line induced draft fan that is preferably located on the back out-take side of the radiator loop. In one embodiment of the present invention, exhaust from the primary heat recovery device 211 enters the reverse chiller at approximately 350 degrees Fahrenheit. Water within the radiator then begins to condense, and continues condensing as the exhaust gas is reduced in temperature to preferably 70 degrees Fahrenheit. The rapid cooling of the exhaust from the primary heat recovery device 211 causes particulates, such as HCl and $SO_2$, to condense out of the gas. Accumulated pollutants and condensate are then collected in a sump at the low point of the radiator and removed from the system. Cooled exhaust gas is then piped back into the gasification reactor chamber via an additional induced draft fan, and directed to a plurality of cooling fms within the gasification reactor chambers 101, 102, 103. The cooled exhaust is then used as a cooling media, which thereby eliminates the need for an exhaust stack, as required by incineration and pyrolysis operations. Alternatively, once conditions, such as temperature and oxygen content, within the gasification reactor chambers 101, 102, 103 reach predetermined levels, cooled exhaust may be re-introduced into the gasification reactor chamber through a plurality of process gas inlets to aid the gasification procedure.

In the illustrated embodiment, once the at least one heat recovery device has significantly cooled the exhaust gas, it becomes possible to avoid any regulated air emissions by diverting the exhaust to an underground geothermal field 113. Heat from the exhaust passing through the geothermal field 113 may then heat surrounding surfaces, such as soil or a body of water, thereby providing heat to support a number of activities, such as, but not limited to, a greenhouse 117 or an aquaculture bed.

The geothermal field 113 is forcibly vented by an induced draft fan 317 to an absorber 115, such as a monolithic lime or sodium carbonate absorber, for the removal of at least a portion of criteria pollutants. For example, if the feed stock material contained plastics, or other substances which might cause the formation of either HCl or $SO_2$, the exhaust leaving the at least one heat recovery device will be diverted to a passive sodium carbonate absorber to reduce any potential for excessive levels of these chemicals in the end recycled process gas product.

As a final step, at a juncture 148, the filtered gas is pulled from the system and into a carbon dioxide extractor 116, which retrieves gaseous carbon dioxide for a carbon dioxide consumer. Oxygen produced by the consumption of extracted carbon dioxide, such as the conversion of carbon dioxide into oxygen by vegetation, may be vented back into the system 100 via a return air line 118 to provide recycled process gas or a cooling medium for the gasification reactor chambers 101, 102, 103.

In another iteration of the design, a greenhouse 117, or some other agricultural carbon dioxide dispersal system replaces the carbon dioxide extractor 116. Carbon dioxide is then sequestered before the balance of the filtered exhaust stream is returned to the gasification reactor chambers 101, 102, 103 via the return air line 118 as recycled process gas.

Combustion Loop Detail

Figure 2:
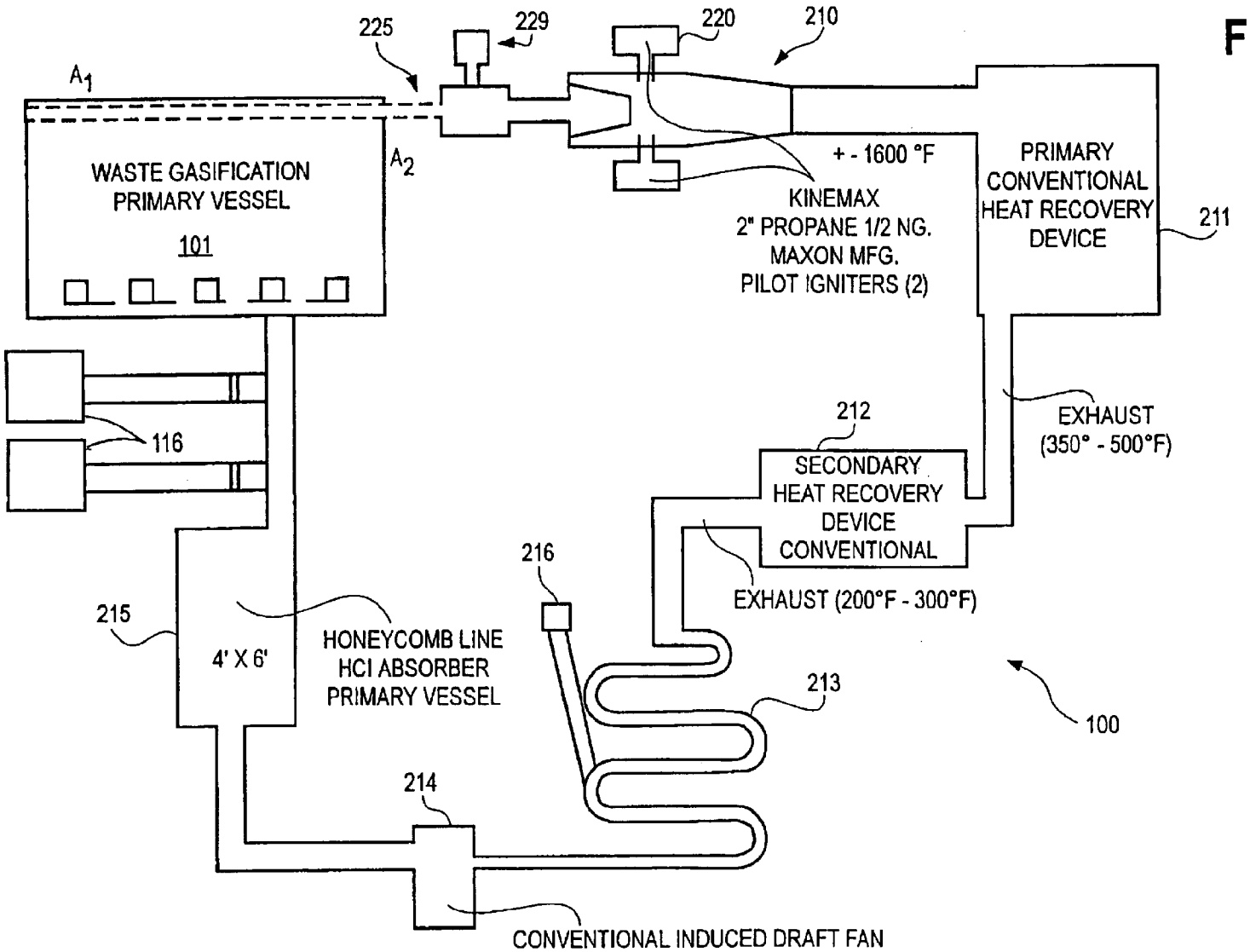
FIG. 2 shows a variant of the process flow of an embodiment of the invention.
Figures 3A, 3B, 3C:
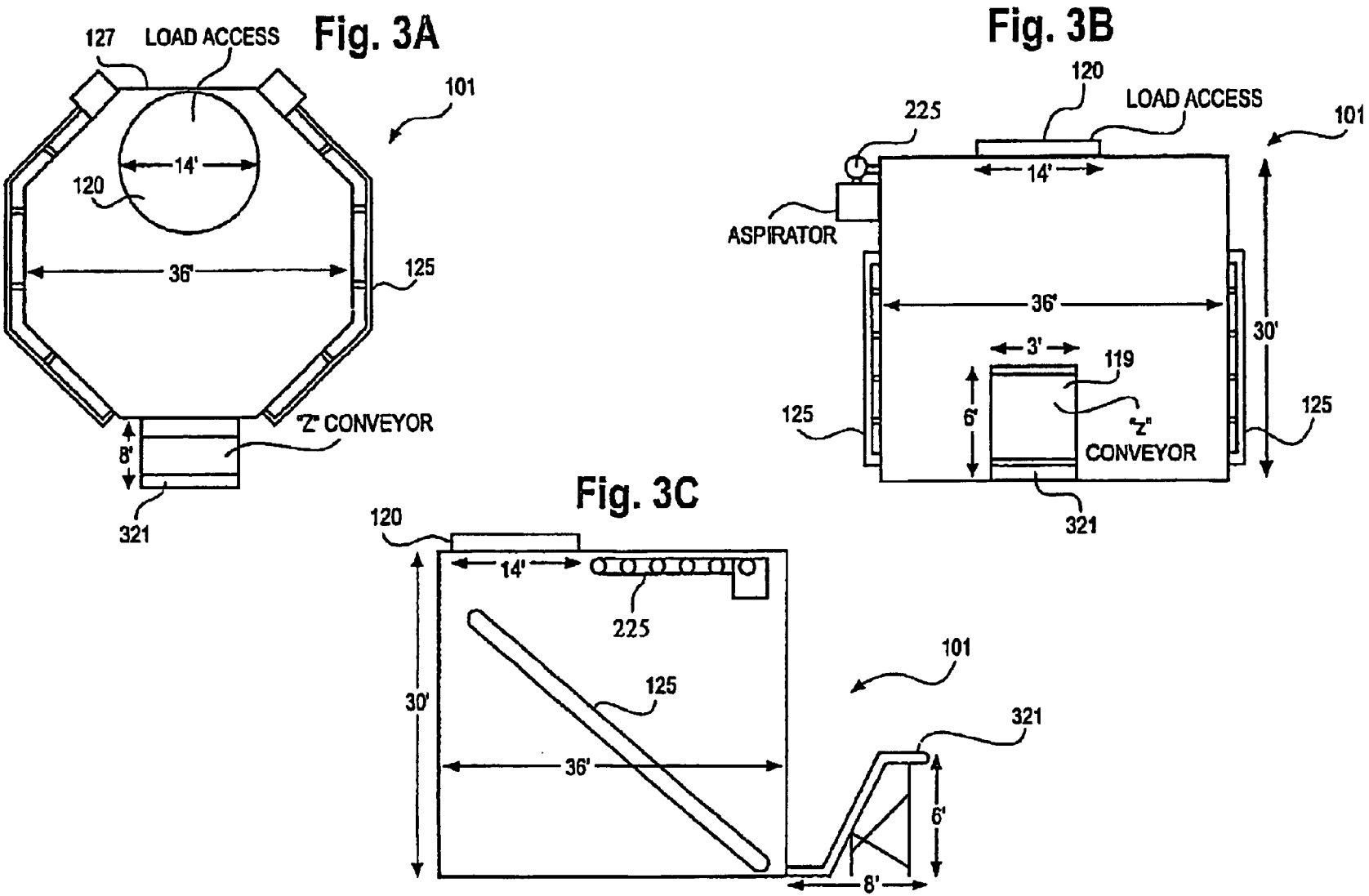
FIGS. 3A, 3B, and 3C show exterior views of a gasification reactor chamber for use with the present invention.

FIG. 2 illustrates additional detail of the gasification system 100 combustion process loop. Feed stock material is fed into the gasification reactor chamber 101 through the primary access loading door 120, as shown in FIG. 3B. The primary access loading door 120 and any other residual removal ports are then sealed, and all gasification process gas intake ports are closed. The aspirator assembly 229 then starts reducing the volume of ambient air within the gasification reactor chamber 101. Following this air purge, which typically for a system containing 50 tons of feed stock material may take 15 minutes, at least one heater that is near the base of the gasification reactor chamber 101 is activated. In the preferred embodiment of the present invention, the heater may include, but is not limited to, a fuel-fired burner or an electric thermal radiant heat assembly.

Once the ambient temperature inside the gasification reactor chamber 101 reaches a predetermined temperature, the heater is turned off. For example, in a system containing 50 tons of mixed feed stock, a predetermined temperature of 300 degrees Fahrenheit may be reached in approximately 35 minutes. In the preferred embodiment of the present invention, a pair of Type K thermocouples is used to determine whether the average ambient temperature has reached the predetermined limit. These thermocouples may be positioned in a variety of locations, such as, but not limited to, below the grate, around the midsection of the gasification reactor chamber 101, at the top of the gasification reactor chamber 101, or in conjunction with additional thermocouples in any combination thereof.

As the temperature and oxygen level in the gasification reactor chamber 101 reach predetermined levels, a plurality of process gas inlets located below the grate level of the gasification reactor chamber 101 are slowly opened. By controlling the flow of process gas, including outside ambient air and recycled process gas from the extractor, the plurality of process gas inlets act as valves to keep the average internal temperature of the gasification reactor chamber 101 within a predetermined range and prevent the incursion of ambient air, which may increase the oxygen level of the process air and cause combustion, from entering into the gasification reactor chamber 101. In the preferred embodiment of the present invention, this predetermined temperature range is within approximately 350 and 750 degrees Fahrenheit, while the oxygen level is 4% to 11% of ambient. These predetermined levels facilitate the substochiometric combustion conditions that cause heavy vapor fuel gas to form and rise to the top of the gasification reactor chamber 101 via convection.

In the preferred embodiment of the present invention, the plurality of process gas inlets may be opened by a common electric motor that is controlled through the use of a process logic controller. Oxygen and temperature sensors sample the interior environmental air and relay the information to the process logic controller. The process logic controller may also be connected to data recorders and digital display panels in the system control cabinet. Such sensors may be located in a variety of positions, including, but not limited to, heavy vapor fuel gas evacuation ducts in the ceiling of the reactor and in a reinforced stainless steel cage located on the interior wall of the gasification reactor chamber.

As the temperature inside the gasification reactor chamber 101 continues to climb, the ambient oxygen content within the chamber 101 drops. When the internal temperature and oxygen level reach a predetermined level, such as, but not limited to, approximately five percent of ambient oxygen and 350 degrees Fahrenheit, the aspirator assembly 229 begins extracting heavy vapor fuel gas out from the gasification reactor chamber 101 through an aspirator assembly 229.

The aspirator assembly 229 uses impelled ambient air passing through a conduit coupling to create a negative back pressure in the gasification reactor chamber 101 and the gas siphon assembly 225. This negative pressure creates a suction force that draws heavy vapor fuel gas from the gasification reactor chamber 101 into the gas siphon assembly 225. In the preferred embodiment of the present invention, the gas siphon assembly 225 extends into and out of the gasification reactor chamber 101 (See FIGS. 3B, 3C, 5A, and 6). In the preferred embodiment, a portion of the gas siphon assembly 225 that extends into the gasification reactor chamber 101 is perforated and mounted along the ceiling of the gasification reactor chamber 101. At least a portion of the gas siphon assembly 225 outside of the gasification reactor chamber 101 is insulated. Besides withdrawing heavy vapor fuel gas from the gasification reactor chamber 101, the aspirator assembly 229 also mixes ambient air with the collected heavy vapor fuel gas, thereby creating a mixed gas.

Heavy vapor fuel gas extracted from the gasification reactor chamber 101 will preferably enter the gas siphon assembly 225 at a temperature of approximately 800 degrees Fahrenheit. However, because the aspirator assembly 229 mixes the hot heavy vapor fuel gas with ambient air, the mixed fuel gas released from the aspirator assembly 229 will preferably have a temperature of approximately 600 degrees Fahrenheit, and is delivered to the flare assembly 210 at a rate of approximately 540 CFM.

The flare assembly 210 is operably connected to at least one burner 220 that initiates combustion of the mixed gas. In the preferred embodiment of the present invention, the at least one burner 210 consists of, but is not limited to, two 2 inch propane burners that utilize pilot igniters. Additionally, the combustion temperatures in the preferred embodiment are operated at approximately 1600 degrees Fahrenheit.

In processing 100 tons of MSW in accordance with the present invention, in which the MSW has a heat value of 4290 Btu/hr, it is anticipated that the flare temperature will be 1857 degrees Fahrenheit, and will produce total gas output of 47,903 lb/hr, a sensible heat content of 25,011,241 Btu/hr (ref. 77 degrees Fahrenheit), and a latent heat content of 5,337,774 Btu/hr.

Unlike traditional gasification systems, rather than using an exhaust stack to vent hot combusted gas into the atmosphere, or bottle the gas for ancillary operations, heavy vapor fuel is utilized by at least one heat recovery device. In the preferred embodiment, a primary heat recovery device 211, a secondary heat recovery device 212, and a geothermal field 213 recover heat entrained in the combusted gas.

In the preferred embodiment, the primary heat recovery device 211 is configured to operate on the power or heat generated by the combustion of the heavy vapor fuel gas by the flare assembly 210. In such a design, the flare assembly may be built into, or a subcomponent of, the primary heat recovery device 211. Alternatively, hot exhaust produced by the combustion of heavy vapor fuel gas by the flare assembly 229 may be delivered to, and utilized by, the primary heat recovery device 211. Exhaust from the primary heat recovery device 211 typically has a temperature in the range of 350 degrees to 500 degrees Fahrenheit.

The secondary heat recovery device 212 operates on the combusted exhaust provided by the primary heat recovery device 211. In the preferred embodiment, the secondary heat recovery device 212 further cools the combusted exhaust to the range of 200 degrees to 300 degrees Fahrenheit.

In the preferred embodiment, exhausted combusted gas from the secondary heat recovery device 212 is delivered to a geothermal field 213, which provides a final cooling stage. An induced draft fan 214 preferably provides momentum for combusted gas to pass through the geothermal field 213. The geothermal field 213 will typically produce a final exhaust temperature of 60 degrees to 80 degrees Fahrenheit, which are approximately ambient conditions. In one embodiment of the invention, carbon dioxide separation may be provided at an early stage by a separator 216 that is operably connected to the geothermal field 213.

An absorber 215, such as, but not limited to, a monolithic lime absorber, then filters critical regulated pollutants, such as HCl, from the cooled combusted gas. Filtered exhaust exiting the absorber 215 is typically comprised of water dioxide and carbon dioxide. A carbon dioxide extractor 116, such as, but not limited to, a Wittmann carbon dioxide extractor, is employed to remove the carbon dioxide molecules from the filtered exhaust. In an alternative embodiment, the extractor 116 is replaced by a greenhouse 117, or by an agricultural carbon dioxide dispersion system, whereby carbon dioxide is sequestered from the filtered exhaust. The remaining filtered gas is then re-directed to the gasification reactor chambers 101, 102, 103, where it is re-introduced into the gasification cycle as recycled process gas, and thereby eliminates the need for an exhaust stack.

Extracted carbon dioxide gas may be used for other industrial purposes, or to support vegetation, such as replenishing the carbon content of soil in an agricultural field by passing extracted carbon dioxide through a carbon dioxide dispersal system, or venting it into a greenhouse. In an alternative embodiment of the present invention, oxygen that has been converted from extracted carbon dioxide may be recaptured and reintroduced into the gasification reactor chamber as a cooling medium for the chambers 101, 102, 103, or as part of the ambient process gas intake.

Gasification Primary Vessel Detail

FIGS. 3 and 5 show details of the waste gasification reactor chamber 101 of the present invention. Depending on the quantity of required fuel gas, and density of the selected feed stock, the capacity of the gasification reactor chamber 101 can be configured to hold a wide range of feed stock material, such as, but not limited to, as little as one ton or as much as one thousand tons of feed stock material.

Figure 5B:
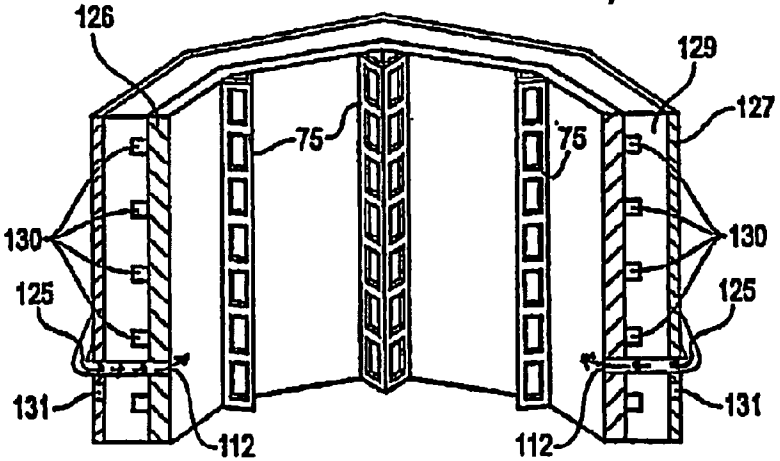
FIG. 5B shows a perspective cross sectional view of the gasification reactor chamber made in accordance with one embodiment of the present invention.
Figure 5A:
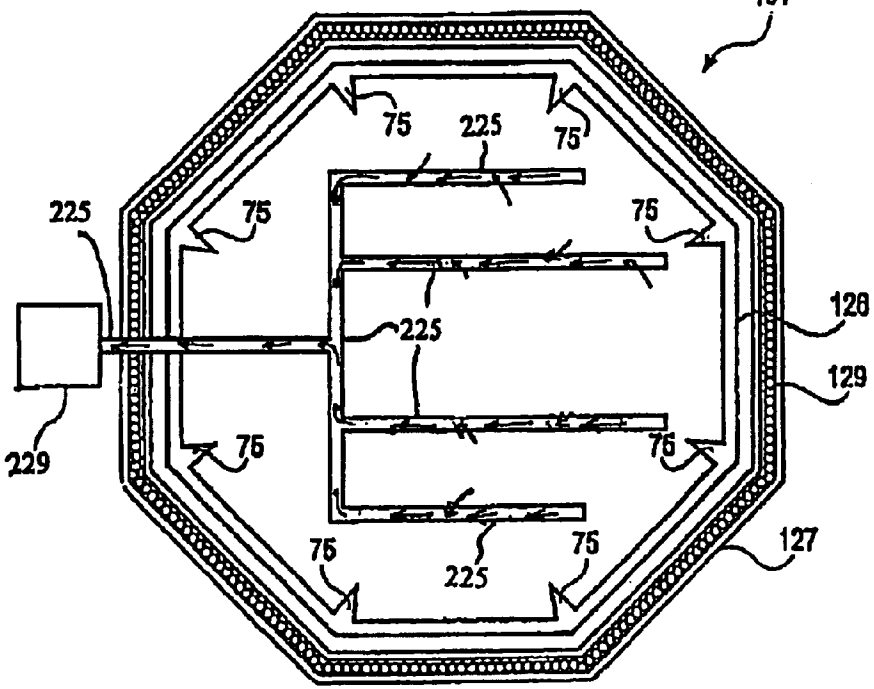
FIG. 5A shows a cross sectional top view of the gasification reactor chamber made in accordance with one embodiment of the present invention.

FIGS. 5A and 5B display the basic configuration of the illustrated embodiment of the gasification reactor chamber 101. As shown in FIG. 5A, the gasification reactor chamber 101 incorporates a double walled configuration, in which the interior chamber 126 is sleeved inside the outer shell 127. While the interior chamber 126 of the present invention is capable of having a rectangular, square, or cylindrical configuration, the preferred embodiment of the present invention has at least five side walls, such as an octagonal or hexagonal shape, and is a continuously welded container of ½ inch thick, 304 or 316 stainless steel plate or cast iron. In one embodiment of the invention, the gasification reactor chamber 101 is an octagonal reactor chamber that is designed to hold approximately 50 tons of feed stock material, and will be approximately 24 feet tall and 8 feet wide on the sides.

Additionally, at least one burner 220 is operably connected to the interior chamber 126, the at least one burner 220 providing heat to elevate the temperature inside the interior chamber 126. In the preferred embodiment of the invention, two openings are positioned beneath grate level, each opening being operably connected to at least one natural gas or LPG-burner, thermal lance, electrical resistance heat generator, or other heat generating device.

Figure 5D:
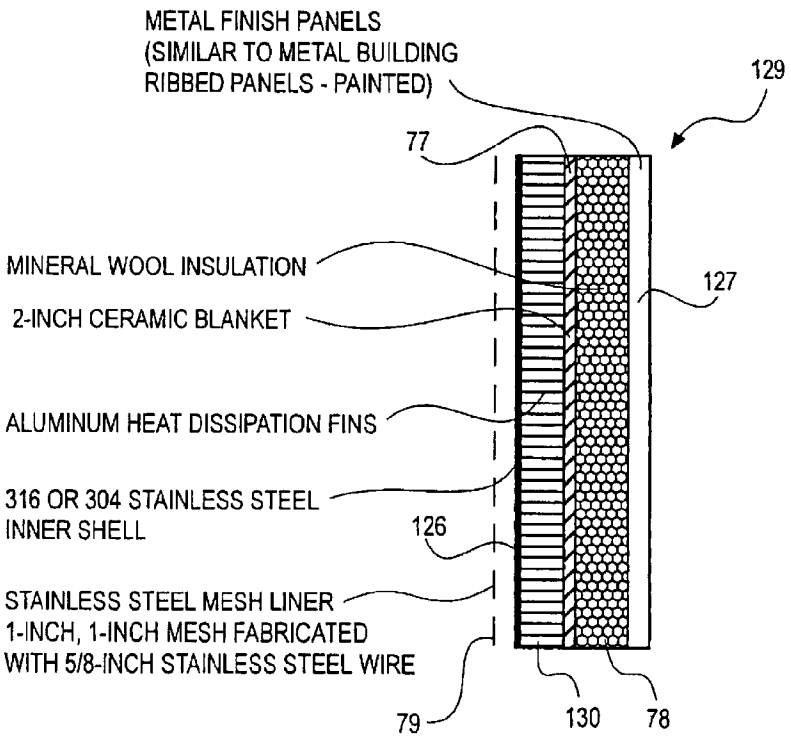
FIG. 5D shows a cross sectional side view of the outer shell and interior chamber for the gasification reactor chamber of the present invention.

FIG. 5D illustrates a cross sectional side view of the gasification reactor chamber in accordance with one embodiment of the present invention. The outer surface of the interior chamber 126 includes a plurality of aluminum convective cooling fins 130 that dissipate heat away from the surface of the interior chamber 126. Between the cooling fins 130 and the interior surface of the outer shell 127 is at least one layer of insulation 129. The preferred embodiment of the invention utilizes an insulative jacket that is comprised of two layers of insulation, with the first layer 77, which covers the cooling fins, and which preferably is a 2 inch thick blanket of ceramic fiber. Adjacent to the first layer 77 is a second layer 78, the second layer 78 being preferably comprised of an 8 inch thick layer of mineral wool block, which is an inexpensive and durable heat-dissipating industrial material that is commonly used for covering hot pipes.

The preferred embodiment of the invention also includes vents 131 located on the sides of outer shell 127, as illustrated in FIG. 5B. Because of the temperature gradient between the cooler outside ambient air and the elevated temperatures of the gasification reactor chamber 101, these vents 131 allow for outside air to rise into the space between the interior chamber 126 and the outer shell 127, and through the at least one layer of insulation 129, thereby providing cooling air flow through the mineral wool. In the preferred embodiment of the present invention, such vents 131 could allow for a sustainable external temperature of approximately 100 degrees Fahrenheit.

When needed, ambient air and/or recycled process gas is supplied to the gasification reactor chamber 101. Ambient air may be provided to the gasification reactor chamber 101 through a plurality of process gas inlets 112 as shown in FIGS. 3B, 3C, and 5B. In the preferred embodiment of the present invention, each wall of the interior chamber 126 has at least one process gas inlet 112, each process gas inlet 112 having a 6 inch diameter. Furthermore, at least two of these process gas inlets 112 are preferably operably connected to a common gas supply manifold 125. In the preferred embodiment, the manifolds 125 are comprised of 8 inch diameter tubing that circumscribes the outside diameter of the gasification reactor chamber 101, the tubing having a first end and a second end, the first end being connected to a variable speed blower that is located outside of the gasification reactor chamber 101, and the second end being completely occluded. Additionally, a damper is preferably operably positioned between the blower and the manifold, the damper being configured to control the introduction of the limited process gas necessary to maintain the gasification cycle and to prevent the inclusion of unwanted ambient air in the interior chamber 126.

Recycled process gas may be returned to the gasification reactor chamber 101 via a return air line 118. In the preferred embodiment of the invention, the recycled process gas may be used as a cooling media for the gasification reactor chamber 101, in which the recycled process gas flows between the insulative jacket and the outer shell 127. Alternatively, the return air line 118 provides a path for the controlled introduction of the recycled process gas into the interior chamber 126, the return air line being operably connected to the plurality of process gas inlets 112.

FIGS. 3A, 3B, and 3C illustrate the outer shell 127 of the illustrated embodiment of the present invention. The outer shell 127 is preferably constructed from A36 hot rolled structural shapes and steel sheet that may be similar to painted metal ribbed panels, and provides mechanical support for the loaded reactor vessel. The outer shell 127 may also provide attachment points for monitoring, ducting, insulation, and other gasification operating equipment.

Figure 3D:
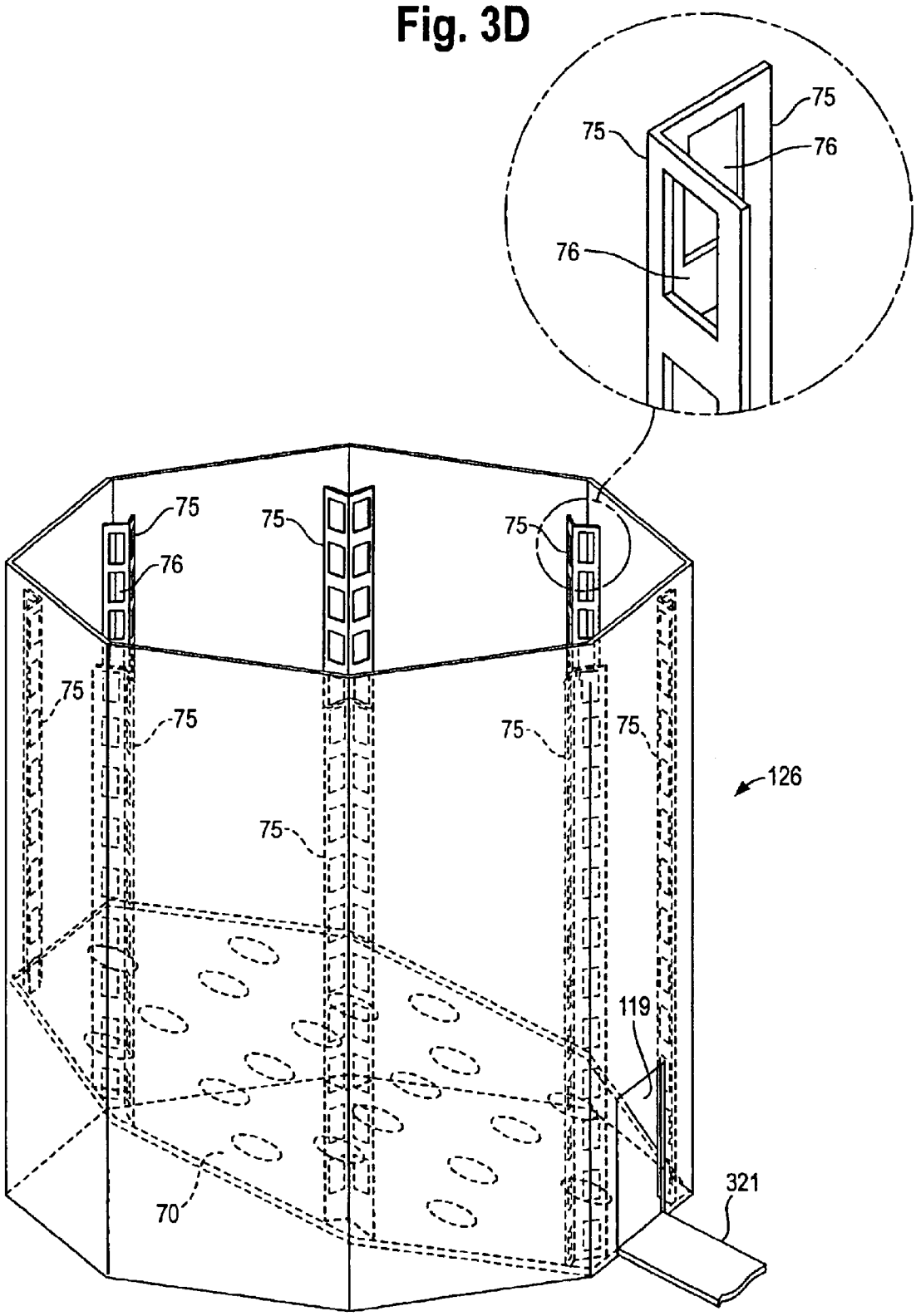
FIG. 3D shows a perspective view of one embodiment of the interior chamber of the gasification reactor chamber for use with the present invention.

Feed stock is loaded into the gasification reactor chamber 101 through an access loading door 120, as shown in FIG. 3A, and placed on a grate 70, as illustrated in FIG. 3D. The gasification reactor chamber 101 may also include an additional opening near the floor of the chamber that is just below the highest edge of the bottom grate 70, and which allows for access for maintenance and repairs. In the preferred embodiment of the present invention, the maintenance opening is bolted and gasket into place.

Removal of residual solid waste after gasification is accomplished through a disposal opening 119, and is preferably lead away from the gasification reactor chamber 101 via a conveyor 321. The exact arrangement of the conveyor system is not critical and any arrangement for conveniently removing solid byproducts is acceptable so long as the gasification reactor chamber 101 can be sealed off from outside ambient air during the gasification cycle. Furthermore, the grate 70, which supports feed stock material within the gasification reactor chamber 101, may have a sloped configuration that is designed to facilitate the movement of solid waste product remaining after the gasification process towards the disposal opening 119, as illustrated in FIG. 3D.

In the preferred embodiment of the present invention, both the disposal opening 119 and the primary access loading door 120 are hydraulically activated doors that are formed from ⅛ inch thick type 304, stainless steel, and are insulated with a ceramic blanket and/or mineral wool fiber. A seal insures an air-tight fit between the door and the top of the reactor.

In one embodiment, the interior chamber 126 may include at least one inclined surface 132, the at least one inclined surface 132 having a first portion 250 and a second portion 251, the first portion 250 being operably connected to the bottom portion 128 of the plurality of sidewalls of the interior chamber 126, and tapers inwards toward the longitudinal axis of the interior chamber 126. The second portion 251 is operably positioned in proximity to the disposal opening 119.

Figure 3E:
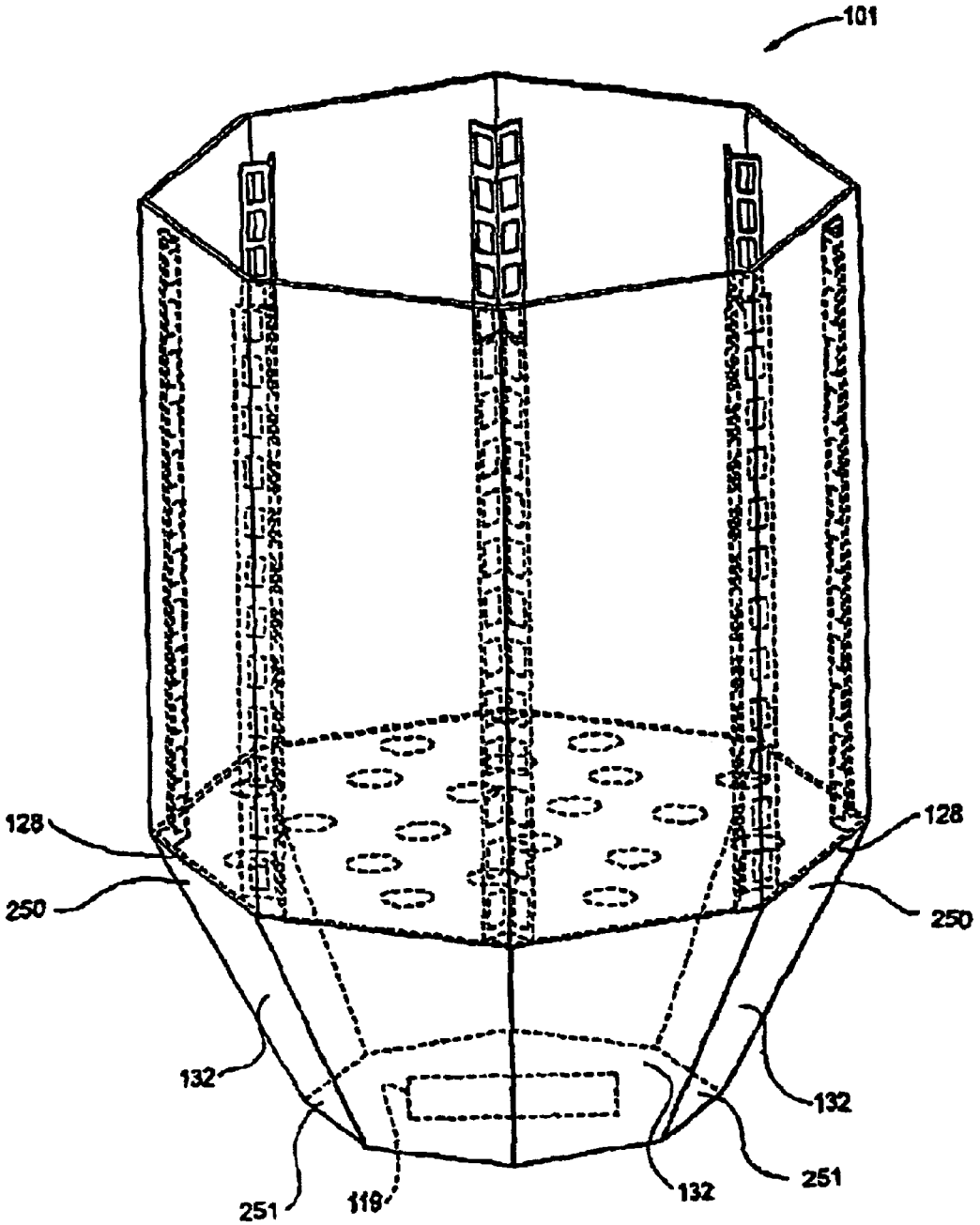
FIG. 3E shows an exterior perspective view of one embodiment of the interior chamber and an inclined waste disposal configuration of the gasification reactor chamber for use with the present invention.

The present invention increases the primary and secondary reaction zones through the incorporation of at least one perforated conduit 75, as illustrated in FIGS. 3D, 3E, and 5A. In the preferred embodiment, the perforated conduit 75 extends from the base of the perforated grate 70 towards, but not reaching, the ceiling of the gasification reactor chamber 101, the perforated conduit 75 including a plurality of perforations 76. As illustrated in FIG. 5A, the perforated conduit 75 is preferably positioned in proximity to the intersection of the gasification reactor chamber 101 walls, and extends outwards towards the center of the interior chamber 126. In the illustrated embodiment, the plurality of process gas inlets 112 passing through the walls of the interior chamber 126 are positioned relative to the location of the at least one perforated conduit 75. The perforated conduit 75 then provides a passageway that permits gasification process gas to travel in an upward direction along the perforated conduit 75. This configuration prevents the flow of process gas from being occluded by feed stock material covering the plurality of process gas inlets 112. The plurality of perforations 76 are also configured to allow for the exposure of additional feed stock surface area to gasification process gas, with at least a portion of the perforated conduit 75 adding to the total surface area of the primary reaction zone, and the remaining exposed surface area adding to the total surface area of the secondary reaction zone. However, the at least one perforated conduit 75 may be also positioned at a variety of locations, including, but not limited to, being offset away from the walls and towards the center of the interior chamber 126, at various locations along the walls of the gasification reactor chamber 101, and all other positions that would be understood and appreciated by one of ordinary skill in the art. In the preferred embodiment, the at least one perforated conduit 75 has a one foot by one foot construction and extends to within four feet of the top of the interior chamber 126, with the top of the perforated conduit 75 being sealed with a solid cap.

The use of perforated conduits 75 also allows the gasification reactor chamber 101 to have a column configuration that includes at least five sidewalls. This column configuration and perforated conduits 75 configuration eliminates the 50 ton capacity limitation of prior art gasification reactor chambers. Furthermore, feed stock material may be top loaded into the column configuration, which may be achieved through the use of a conveyor, and thereby may eliminate repose fill problems associated with side loading a rectangular gasification reactor chamber configuration.

Figure 5C:
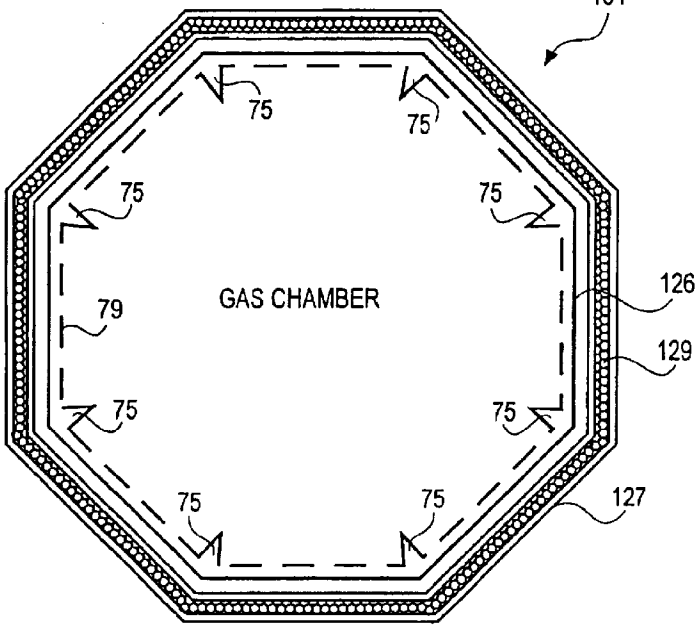
FIG. 5C shows a perspective cross sectional view of the gasification reactor chamber including an inner liner in accordance with one embodiment of the present invention.

FIGS. 5C and 5D illustrate an alternative embodiment of the gasification reactor chamber 101, in which an inner liner 79 is placed within the interior chamber 126. The inner liner 70 is preferably positioned so as to leave a gap between the sidewalls of the interior chamber 126 and the inner liner 79. The inner liner 79, which may be constructed from heavy wire mesh, has a plurality of perforations that permit the flow of gasification process gas to the feed stock material. In the preferred embodiment, the inner liner 79 is a one inch by one inch stainless steel mesh fabricated from ⅝ inch stainless steel wire and positioned two to four inches away from interior surface of the interior chamber 126. Process gas is then able to circulate in and around the feed stock material along the sides of the inner liner 79, thereby allowing the side surfaces of the feed stock material to become part of the primary reaction zone. Additionally, because the inner liner 79 physically contains the feed stock material, the walls of the interior chamber 126 do not have any mechanical contact with the feed stock material. This lack of contact allows the walls of the interior chamber 126 to be fabricated from substantially thinner material, thereby further reducing the weight and fabrication expenses of the gasification reactor chamber 101. Although FIG. 5C illustrates the inner liner 79 being used in conjunction a plurality of perforated conduits 75, the liner 79 may also be configured to eliminate the need for the perforated conduits 75, while still preventing the plurality of process gas inlets 112 from being occluded by feed stock material.

The increased exposure of feed stock material to gasification process gas significantly increases the sizes of the primary and secondary zones, which allows for a faster gasification procedure at lower temperatures. For example, prior art rectangular gasification reactor chambers that are designed for 50 tons of feed stock material will typically have a primary reaction zone area of 120 square feet, and an additional 800 square feet of secondary reaction zone at the uppermost surface of the waste zone, for a total primary and secondary reaction zone of 920 square feet. However, the octagonal gasification reactor chamber 101 of the present invention that is designed to hold the same 50 tons of feed stock material, and which includes eight perforated conduits 75, has a primary reaction zone of 498 square feet at the sloped perforated grate 70, plus an additional 384 square feet from at least the lower portion of the perforated conduits 75, for a total primary reaction zone of 882 square feet. As the temperature of the gasification reactor chamber 101 stabilizes, an additional 782 square feet of secondary reaction zone is created, which is comprised of 384 square feet from at least a portion of the perforated conduits 75, and 398 square feet from the upper surface area of the feed stock. The total primary and secondary reaction zone surface area is therefore 1,664 square feet, roughly 1.78 times that of conventional rectangular reactors.

The addition of the inner lining 79 to the eight perforated conduits 75 described in the above-mentioned 50 ton octagonal gasification reactor chamber 101 increases the surface area of the primary reaction to 2,002 square feet. When added to the 384 square feet of the secondary reaction zone, which is created at the top of the feed stock material, the primary and secondary reaction zones provide a total feed stock reaction surface area of 2,386 square feet.

Because gasification cycle time is a function of feed stock surface area exposure to gasification process gas, an increase in the surface area of the primary and secondary reaction zones represents a significant reduction in the rate of reaction necessary for gasification, and thus reduces the cycle time required for a single charge of feed stock. Thus, for example, the maximum anticipated volume of heavy vapor fuel gas produced from feed stock material in the present invention could be reduced to less than 12 hours, instead of the 18 to 24 hour cycle times of prior art systems. By decreasing both the time and temperature required for the gasification of feed stock material, the present invention further eliminates the need to rely on multiple gasification reactor chambers to meet system volume capacity requirements. Furthermore, this configuration substantially reduces the external surface temperature of the gasification reactor chamber 101 during operation, thereby making the environment around the system safer for workers.

The lower operating temperature within the gasification reactor chamber 101 of the present invention also improves the ultimate air quality of the final system exhaust. Constant cooling of the interior chamber 126 by convection helps stabilize the gasification reactor chamber 101 temperatures to as low as 750 degrees Fahrenheit. At this temperature level, there is insufficient thermal energy to create many of the complex chemical reformation reactions that occur in mass burn incinerators, some pyrolysis systems, some high temperature gasifiers, and plasma systems from the various materials that comprise the feed stock material within the reactor. Depression of the optimum operating temperature also inhibits the volatilization of most metals, thus virtually eliminating the metal content in exhaust air from the total system.

The simplified single gasification reactor chamber 101 of the present invention also has significant financial benefits over large, multi-celled fixed systems, in terms of flexibility, portability, and economics of installation, operation, and maintenance. Faster gasification cycles at lower temperatures permit the gasification reactor chamber 101 to be fabricated from lighter and less expansive material. In comparison to prior art systems, the lightness of both the gauge of the material and insulative layers produces a significant reduction in the overall weight of the system. This reduction in weight translates into both lower material and installation expenses. Furthermore, the time required for fabricating and installing such a system is greatly reduced by the elimination of refractory materials and associated refractory hanger installation. The absence of weight attributable to refractory materials also allows for the use of lighter structural steel members. Repair and maintenance profiles for a stainless steel system are far superior to hot rolled steel structures that are painted. Additionally, the relative small size of the present invention allows a single gasification system 100 to be economically and efficiently sited at the location of the fuel demand, such as the location of the at least one heat recovery device. These benefits allow a single gasification reactor chamber supplying energy from this alternative fuel-generating reactor to be economically and efficiently sited at the location of the fuel demand.

Gas Extraction Details

Figure 6:
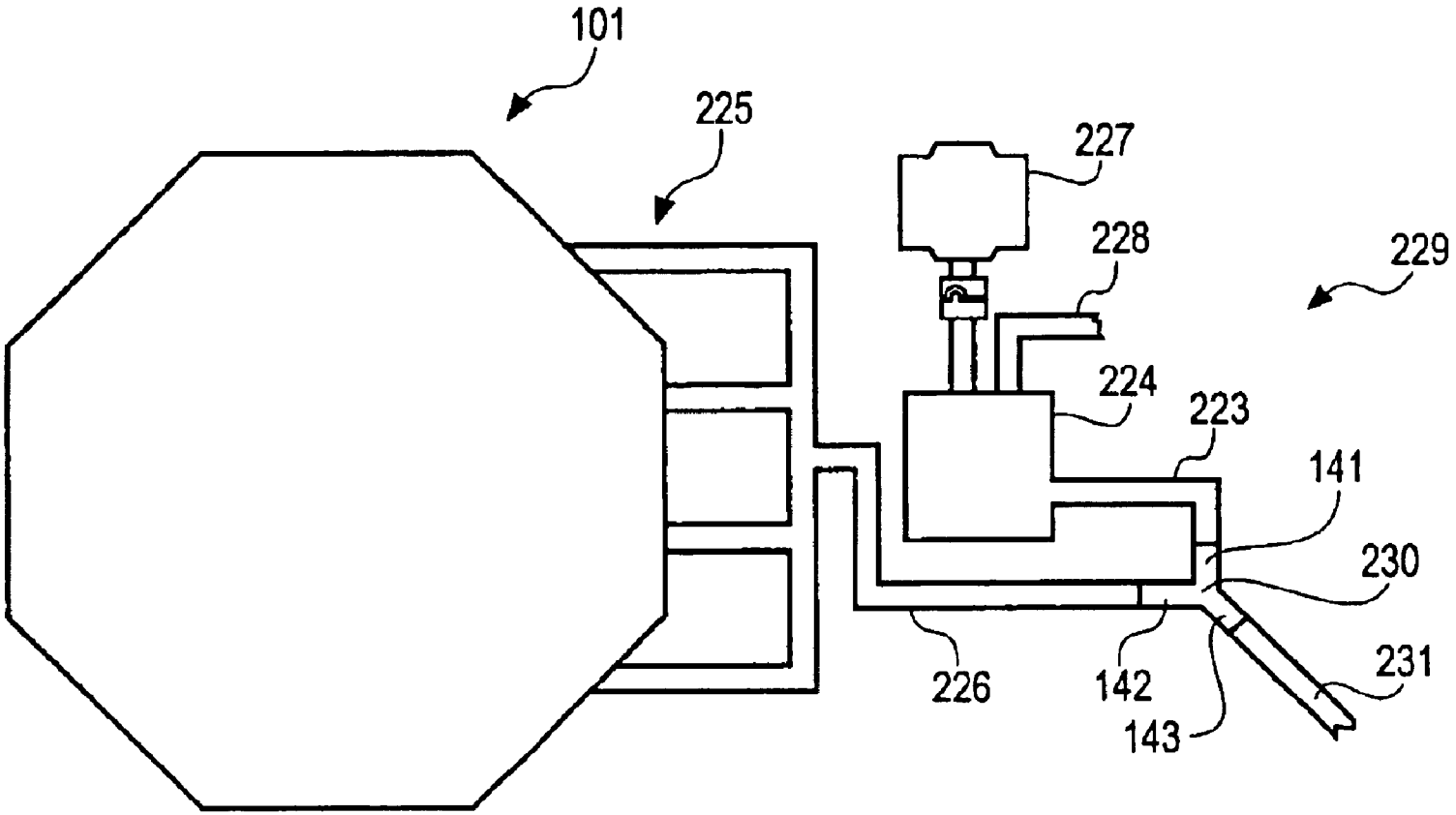
FIG. 6 shows an aspirator assembly for use with the present invention.

FIG. 6 illustrates details of the gas extraction assembly of the present invention. The extraction scheme includes an aspirator assembly 229 that replaces the air-mixing chamber of the prior art. The aspirator assembly 229 is capable of both evenly withdrawing heavy vapor fuel gas from the gasification reactor chamber 101 and completely mixing impelled ambient air with the extracted oxygen-deficient heavy vapor fuel gas, thereby creating an oxidized mixed gas. The aspirator assembly 229 can also provide transport of the mixed gas over greater distances than conventional methods, thereby making the whole system more adaptable than current designs, especially for multiple cell systems.

A damper assembly, which is the norm in prior art gasification systems, has been eliminated in the present invention in favor of employing a variable speed motor 227 as the driving device for extracting gas from the gasification reactor chamber 101. The motor 227 forces ambient air through a second passageway 228 and into an impeller 224, which subsequently supplies impelled air through a passageway 223 and into a conduit coupling 230. In the preferred embodiment of the invention, the motor 227 is a 10 hp motor that is mounted approximately 7 feet above floor level, the motor 229 being operably connected to a shutoff valve that is located thirty feet above floor level.

Figure 7:
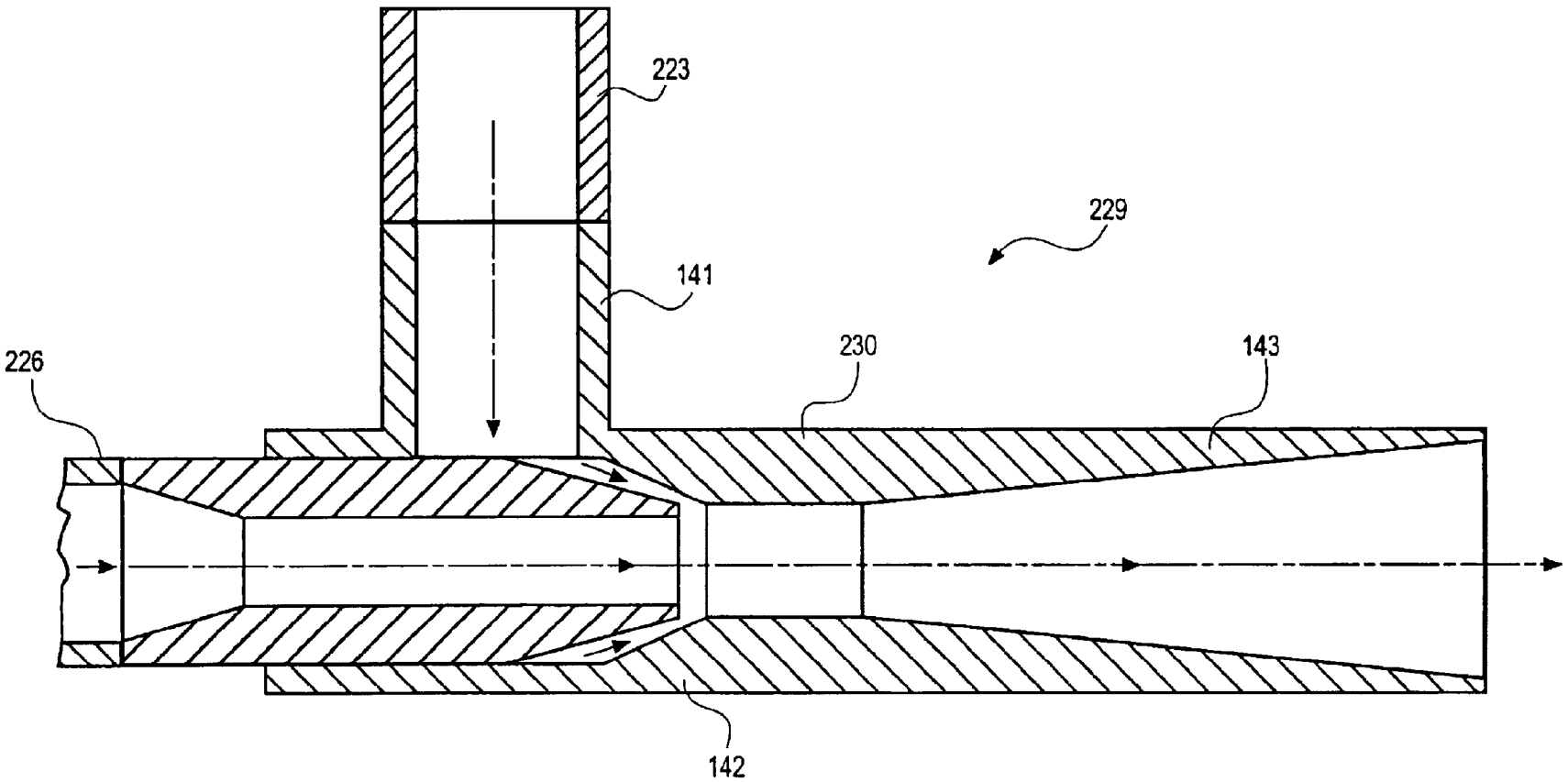
FIG. 7 shows a cross-sectional view of a conduit coupling for use with the aspirator assembly shown in FIG. 6.

FIG. 7 illustrates the preferred embodiment of the conduit coupling 230, which is shown as having a "Y" configuration, but may have a number of different configurations, including a "T" shape, as would be understood and appreciated by one of ordinary skill in the art. In the preferred embodiment, the conduit coupling 230 is readily available from an industrial supply source. The conduit coupling 230 is comprised of a first leg 141, a second leg 142, and a stem 143. High velocity impelled air passing along the first leg 141 and through the stem 143 of the conduit coupling 230 creates a suction force in the second leg 142, the attached single manifold pipe 226, and the gas siphon assembly 225, thereby creating a slight negative pressure in the interior chamber 126. As heavy vapor fuel gas is produced and rises to the top of the interior chamber 126, the suction force created in the conduit coupling 230 draws the heavy vapor fuel gas into the portion of the gas siphon assembly 225 that extends inside the interior chamber 126, as illustrated in FIG. 5A. The gas siphon assembly 225 is sized according to the type of feed stock material and designed for the capacity of the chamber 101. In the preferred embodiment of the invention, the gas siphon assembly 225 is comprised of 3 inch diameter 316 stainless steel schedule 40 piping. The pipes are preferably mounted along the ceiling of interior chamber 126, and terminate at the single manifold pipe 226, with at least a portion of the piping inside the gasification reactor chamber 101 being perforated so as to permit heavy vapor fuel gas to pass into the gas siphon assembly 225.

The suction force created by the aspirator assembly 229 allows for smooth and even extraction of heavy vapor fuel gases from the interior chamber 126, and increases the quantity of extracted heavy vapor fuel gas. This even and smooth extraction provides a number of benefits, including: causing the gasification process to work with less fluctuation in gas volume removal from the gasification reactor chamber 101 as the gasification process works its way through the raw feed stock material; reduces the total primary gasification process cycle time; and supplies a more homogenous and regulated flow of heavy vapor fuel gas product to the ultimate burner system that will combust the gas in the employed heat recovery strategy of the present invention.

Once the heavy vapor fuel gas reaches the conduit coupling 230, the influx of hot heavy vapor fuel gas into the cold impelled ambient air stream creates considerable turbulence in the down-stream pipe 231. This turbulence is more than adequate to accomplish air mixing, and will add ambient air volume to the heavy vapor fuel gas that is approximately equal to that produced in conventional air-mixing chambers.

The aspirator assembly 229 also overcomes problems associated with accelerating mixed gas for use in ancillary systems. In the preferred embodiment, the gas siphon assembly 225, single manifold pipe 226, passageway 223, conduit coupling 230, and downstream pipe 231 are constructed from small diameter tubing, which, in conjunction with the motor 227, increases both the velocity and turbulence of the passing ambient air and heavy vapor fuel gas. As compared to the mixing obtained through conventional prior art methods, the increased velocity and turbulence created by the present invention significantly contributes to increasing the mixing of the gases, which improves the completeness of the combustion event.

This accelerated velocity may also provide back pressure for the supply lines to attached heat recovery devices, which allows for the proper functioning of such devices. In some instances, this increased velocity also makes the heat recovery device more efficient. Additionally, unlike prior art induced draft systems, the increased mixed gas velocity allows the invention to operate equipment that require higher positive gas input pressures, such as common bottoming cycle electrical power generation turbines, boilers, carburetors, and other fuel consuming devices that require a given amount of supply line gas pressure in order to function properly. Unlike the current invention, prior art designs were typically unable to satisfy such positive pressure requirements, either due to the inability to pressurize the gas because of dependence on natural draft-driven processes, or because of problems and expense associated with the application of high temperature, in-line, induced draft fans.

Furthermore, gasification process efficiency is directly related to the ability to control various functions through equipment sub-sets in the gasification process. For instance, rather than provide finite control of the oxidation of the fuel gas, prior art damper assemblies typically guess at the amount of flow volume moving through the damper valve body. Unlike the prior art however, the vacuum power and mixing air percentage of the aspirator assembly 229 of the present invention can undergo a wide range of adjustment through the modification of the ducting size for both the evacuated heavy vapor fuel gas and the ambient air intake line. Further refinements in air mix and flow can be achieved by varying the speed of the impeller 224. Therefore, elimination of the damper assembly affords the present invention finite control over the extraction rate of the heavy vapor fuel gas from the gasification reactor chamber 101 and the mixing event, and affords direct control over the exact flow volume through the system. Additionally, functions of the aspirator assembly 229 may be even more accurately controlled through the use of process control logic. These improvements allow for a finite level of process control which has not been possible in prior art natural draft systems.

The waste gasification reactor system described herein simplifies prior designs, and is a significantly less costly assembly, providing both a smaller space requirement for such equipment and fewer parts than are represented in prior art systems. The size of the aspirator assembly 229 may be up to 90% smaller than a conventional air-mixing chamber, which dramatically decreases fabrication costs and installation time. The elimination of a centralized gas collection duct, which is common to most prior art waste gasification systems, makes not only the entire configuration of multiple gasification reactor chambers at a given facility more flexible, but also makes a multi-cell configuration simpler and less expensive to operate. Since there is no longer reliance on the central collection duct, the gasification vessels can be arranged independently, or along different vertical planes than previous designs allowed. Furthermore, the flexibility of the present invention does not suffer from the prior art's cumbersome and difficult methods of moving the heavy vapor fuel gas from its point of formation to the point of combustion.

Heavy Vapor Fuel Gas Flare Assembly

The single flare assembly of the prior art is usually a cylinder, approximately 6 feet in interior diameter, and is made of a spun ceramic fiber or refractory casting liner that is positioned inside a steel exterior jacket. Piercing the sides of this assembly along alternating left and right ports are four to eight pilot igniters. These igniters provide an open flame for the purpose of facilitating the combustion of the incoming mixed gasses. The gasification system of U.S. Pat. No. 6,439,135 utilizes a single flare assembly wherein the heavy vapor fuel gas from multiple gasification reactor chambers converges for combustion, and in which the combusted exhaust is typically subsequently vented into the atmosphere via an exhaust stack. The present invention however incorporates a dedicated flare assembly 210*a*, 210*b*, 210*c* for each gasification reactor chamber 101, 102, 103, as illustrated in FIG. 1.

Figure 4:
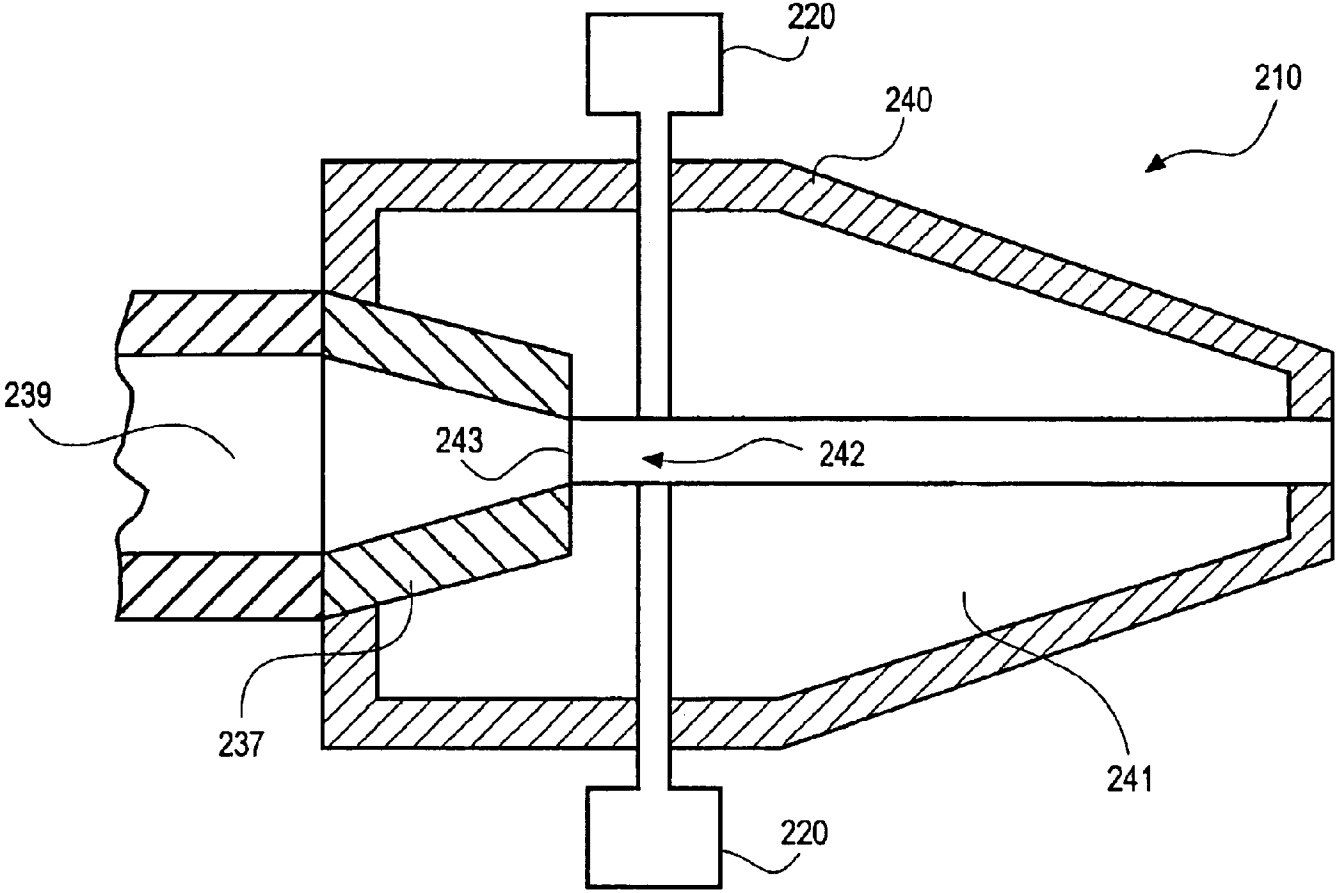
FIG. 4 shows a flare assembly for use in combusting mixed gas with the present invention.

FIG. 4 illustrates the preferred embodiment of the flare assembly 210. The flare assembly is comprised of a targeting nozzle 237, thermal insulation 241, a housing 240, and at least one burner 220. In the preferred embodiment, the targeting nozzle 237 has a conical funnel configuration that is constructed from cast ceramic and is enclosed in a stainless steel housing 240. The conical funnel configuration of the targeting nozzle 237 is configured to restrict the incoming flow of mixed gas 239 from the aspirator assembly 229 into a combustion focus point 242. The conical funnel design of the targeting nozzle 237 supplements the mixing of the heavy vapor fuel gas and ambient air received from the aspirator assembly 229, thereby further improving the combustibility of the mixed gas 239. Additionally, the conical design of the targeting nozzle 237 accelerates the velocity of the mixed gas through the nozzle. Following the nozzle tip 243 is at least one burner 220 that provides an ignition spark or raw flame to ignite the incoming mixed gas. In the preferred embodiment, the at least one burner 220 is comprised of two Maxon Kinemax 2 inch diameter burners.

The flare assembly 210 of the present invention has a number of benefits. The number of igniter burners 220 required to adequately combust the mixed gas is reduced. Reduction in the number of igniter burners 220 substantially reduces the consumption of supplemental fuel by the system. Also, the configuration of the targeting nozzle 237 offers better control for mixed gas flaring, and can also be used as an injection point for the processing of waste oil, paints, or other volatile liquids. The flare assembly 210 is also much smaller than conventional flares. This saves on fabrication and installation expenses, and reduces the overall size of the system.

Primary and Secondary Heat Recovery Device

Unlike traditional gasification systems, rather than use an exhaust stack to vent the combusted gas into the atmosphere, or bottle the gas for ancillary operations, heat is recovered from the flare assembly 210 by at least one heat recovery device. In the preferred embodiment of the present invention, a primary heat recovery device 211 utilizes the combustion of the mixed gas, thereby relying on the fuel content of the heavy vapor fuel gas for operation. In such a device, the flare assembly may be built into, or be a sub-component of, the primary heat recovery device 211. Alternatively, the primary heat recovery device may receive hot combusted exhaust gas from the flare assembly 210, as illustrated in FIG. 2. These combusted gases may be directly supplied as the primary fuel source for powering or heating primary heat recovery devices 211 such as, but not limited to, hot water heaters, boilers, refrigeration systems, dryers, omnivorous fuel/internal combustion engines, and turbines. Such use of heavy vapor fuel gases would provide an alternative to the expense and conservation issues associated with the production, supply, and consumption of fossil fuels for powering such above-mentioned devices.

In the preferred embodiment, exhaust from the primary heat recovery device 211 typically has a temperature in the range of 350 degrees to 500 degrees Fahrenheit. A secondary heat recovery device 212 may be utilized to further to recapture and reutilize the thermal energy entrained in the exhaust from the primary heat recovery device 211, and via subsequent use, provide a further cooled exhaust that preferably has a temperature in the range of 200 degrees to 300 degrees Fahrenheit.

"Closed-Loop" Geothermal Heat Rejection Field

In one embodiment of the present invention, the closed-loop system includes a geothermal field 113 that utilizes the entrained hot air exhaust from the primary or secondary heat recovery devices 211, 212. The geothermal field 113 provides a low cost and maintenance-free system for final thermal energy recovery. This geothermal field 113 also provides a no-operating cost method of reducing exhaust temperatures to meet the intake requirements of emission absorbers 115 and carbon dioxide extractors 116.

Figure 8:
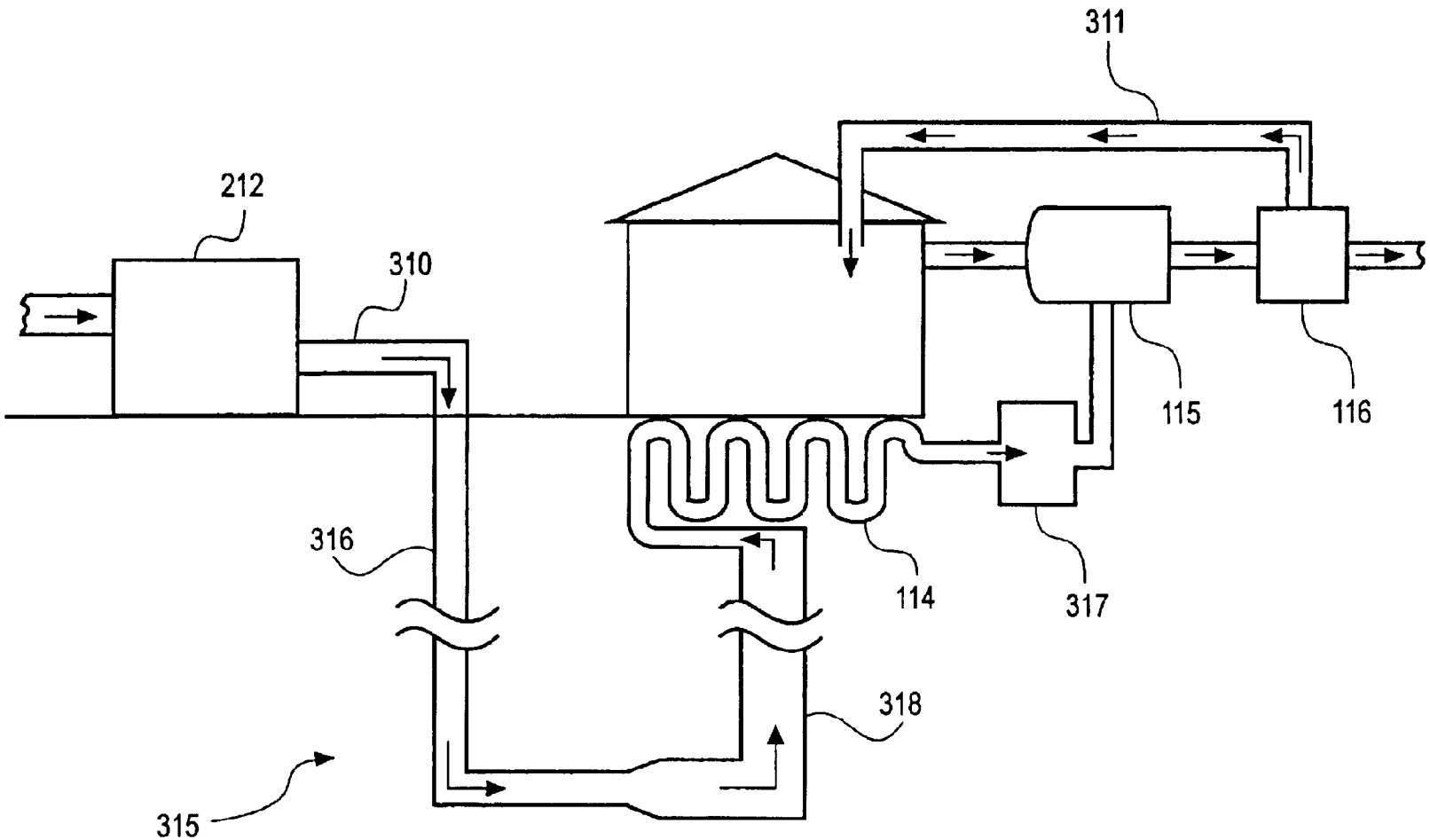
FIG. 8 shows the inclusion of a geothermal field in one embodiment of the present invention.

FIG. 8 illustrates the operation of one embodiment of the geothermal field 113. An induced draft fan 317 provides momentum for exhaust passing through the exhaust piping 310 of the primary and/or secondary heat recovery device 211, 212 to flow through both a subsurface manifold piping system 315 and a geothermal loop 114. The subsurface manifold piping system 315 may be located underground or beneath a body of water, and is comprised of inlet piping 316 and ventilation tubing 318.

As the hot air exhaust travels through the geothermal loop 114, it loses heat through natural convection to the surrounding surfaces. The length of the field is adjusted relative to the total tons of feed stock material being gasified per day. For example, 1,200 feet of piping in a geothermal loop 114 may be adequate for systems up to, and including, 100 tons of feed stock per day, while a system of 200 tons may require approximately 2,600 feet of tubing in the field. Furthermore, a manifold piping system 315 that is comprised of four PVC inlet pipes 316 located six feet below ground or water, and twelve inch diameter ventilation tubing 318, can reduce an intake exhaust heat of 500 degrees Fahrenheit to approximately 200 degrees Fahrenheit.

When the geothermal loop 114 is placed under a greenhouse 117, it warms surrounding soil, which transfers heat to the greenhouse. Ventilation fans may then distribute heat throughout the greenhouse. In winter months, heat provided from the geothermal field 113 is sufficient to maintain environmental temperatures within growing limits, with only minimal supplemental heat needed on the coldest days. This may serve to significantly reduce wintertime costs of greenhouse operations.

Furthermore, as previously discussed, the use of a greenhouse 117 or other vegetative supporting system also allows for the option of venting extracted carbon dioxide from the extractor 116 to a greenhouse 117 via piping 311. Alternatively, as will be discussed hereinafter, the greenhouse 117 or other vegetative system, may also replace the extractor 116, and be used to sequester carbon dioxide out from the filtered exhaust produced by the absorber 115.

Emission Controls

While the formation of noxious pollutants such as HCl and $NO_x$ are greatly reduced in waste gasification processes, measurable quantities of the pollutants may still persist in the exhaust stream from time to time. To handle these residual pollutants, one embodiment of the invention includes an absorber 115, such as, but not limited to, a monolithic lime absorber. An absorber 115 such as a monolithic lime absorber absorbs HCl molecules from exhaust gas that is passed through and around it, thereby reducing the HCl concentration in the gas that is eventually returned to the gasification reactor chamber 101. Alternatively, pollutants may be removed by passing the exhaust stream through a chilled radiator, whereby the pollutants are collected and condensed in water vapor.

When the filtered gas leaves the absorber 115, it is basically comprised of water vapor, oxygen, hydrogen, nitrogen, carbon dioxide, and minimal trace elements. At juncture 148, as shown in FIG. 1, the filtered gas is pulled from the system and into an extractor 116, such as a Wittmann carbon dioxide extractor, which removes the carbon dioxide molecules from the filtered gas. In the absence of an extractor 116, the cooled filtered exhaust may be vented into a greenhouse 117, where vegetation converts the carbon dioxide of the filtered gas into oxygen. Alternatively, the filtered gas may be delivered to a carbon dioxide dispersal system, as previously discussed. The resulting recycled process gas is then mainly comprised of water vapor and air that is delivered through a return line 118 and manifold system back to the gasification reactor chambers 101, 102, 103 for use in the gasification process. Alternatively, the recycled process gas may be used as a cooling media for the gasification reactor chamber 101.

Figure 11:
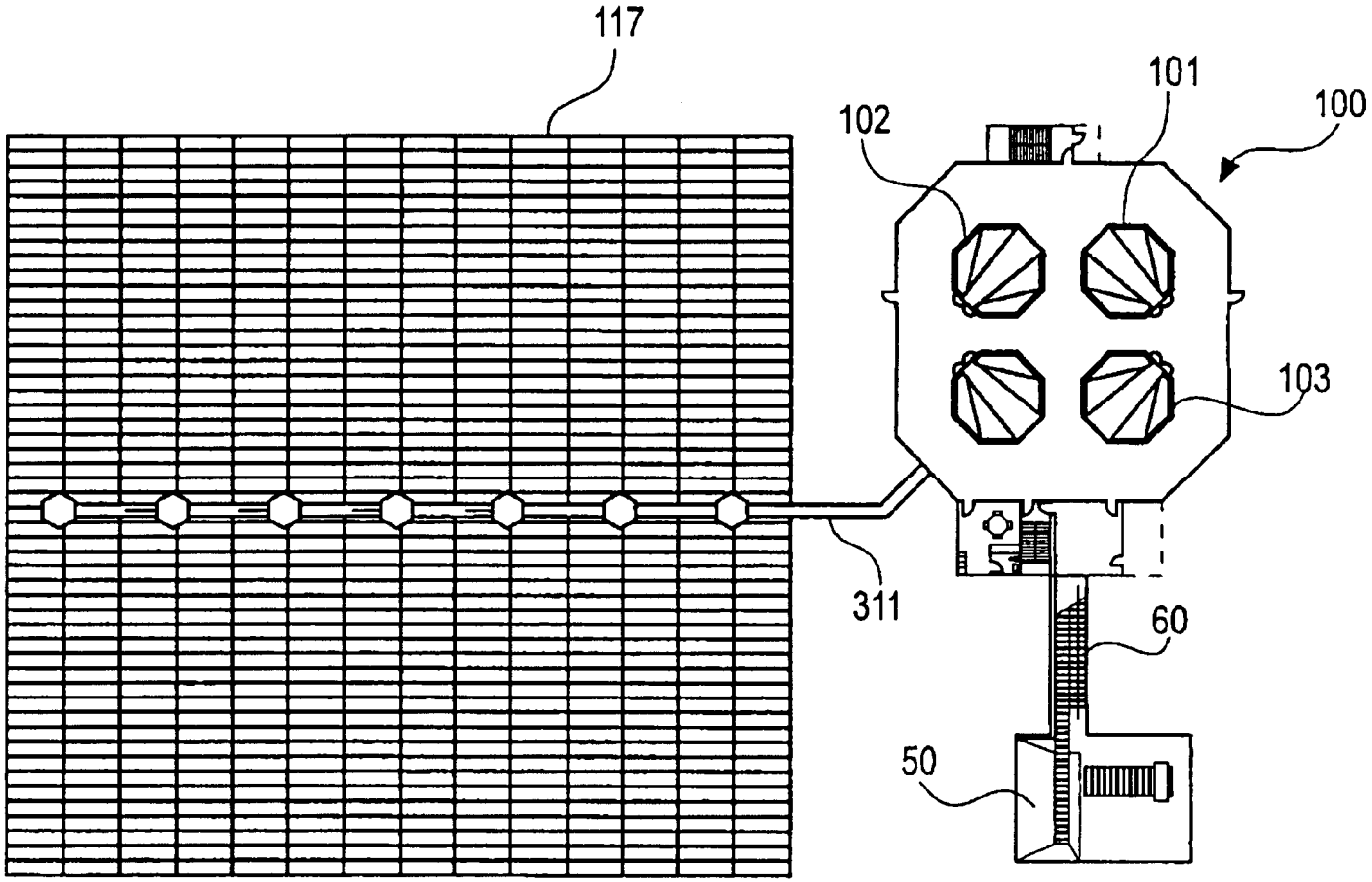
FIG. 11 shows the use of a greenhouse for absorbing carbon dioxide in accordance with one embodiment of the present invention.
Figure 12:
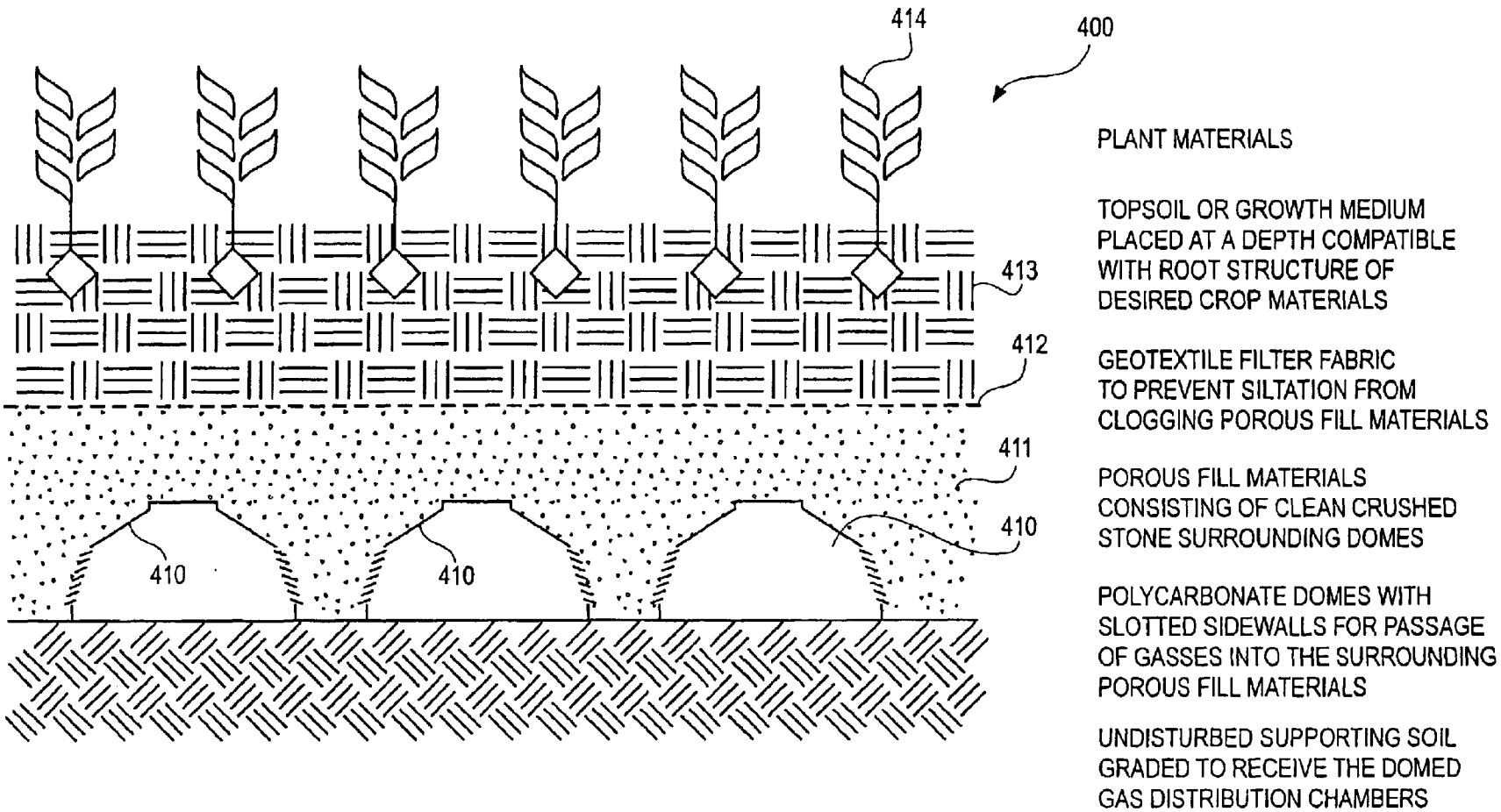
FIG. 12 shows the use of a carbon dioxide dispersal system in accordance with one embodiment of the present invention.

The now cooled filtered exhaust also represents a significant source for clean carbon dioxide. Depending on the size of the gasification system, carbon dioxide extraction could provide environmental and economic advantages. For example, should the gasification system be used to provide energy for a greenhouse operation, as shown in FIG. 11, piping 311 from the system 100 may deliver and vent accumulated carbon dioxide for facilitating plant growth. Properly selected greenhouse plants could easily consume all of the extracted carbon dioxide in a reasonable time, thereby allowing the present invention to emit zero carbon dioxide emission from the disposal of MSW feed stock. Current research indicates that increasing the carbon dioxide level in a greenhouse 117 from ambient to as much as 1,500 ppm can increase the productivity of tomatoes, green peppers, and lettuce by as much as 35%. Alternatively, as illustrated in FIG. 12, extracted carbon dioxide may be vented in a carbon dioxide dispersal system 400, in which carbon dioxide is passed through distribution chambers 410 located beneath, among other things, porous fill materials 411, filter fabric 412, topsoil 413, and vegetation 414. In addition to the vegetation converting the dispersed carbon dioxide into oxygen, released carbon dioxide also replenishes the carbon content of soil.

The foregoing system provides a low cost, closed-loop MSW gasification system that allows for complete material recovery and recycling of metals, glass, minerals, and salts. Furthermore, the present invention may efficiently recapture expended thermal energy while preventing overt discharge of air, solids, or waste water from the disposal of solid waste materials.

While the present invention has been illustrated in some detail according to the preferred embodiment shown in the foregoing drawings and descriptions, it will be understood that the invention is not limited thereto, since modifications may be made by those skilled in the art, particularly in light of the foregoing teaching. It is therefore contemplated by the appended claims to cover such modifications that incorporate those features that come within the spirit and scope of the invention.

What is claimed:

1. A gasification reactor chamber for the gasification of a plurality of solid waste material comprising:

a. a reactor chamber comprised of a plurality of sidewalls, the reactor chamber configured to receive the insertion of the plurality of solid waste material;

b. a plurality of process gas inlets operably connected to the reactor chamber, the plurality of process gas inlets configured to allow the flow of a process gas into the reactor chamber;

c. a perforated liner comprised of a plurality of perforations, the perforated liner operably connected to at least a portion of the plurality of sidewalls, at least a portion of the perforated liner configured to restrain at least a portion of the plurality of solid waste material away from at least a portion of the plurality of sidewalls, the plurality of perforations configured to allow the passage of at least a portion of the process gas to at least a portion of the surface area of the adjacent solid waste material; and d. at least one layer of insulative material operably connected to at least a portion of the plurality of sidewalls.

2. The invention of claim 1 wherein the perforated liner is comprised of wire mesh.

3. The invention of claim 1 wherein the perforated liner is comprised of at least one perforated column.

4. The invention of claim 3 wherein at least one of the at least one perforated column is located in proximity to the intersection of the plurality of sidewalls.

5. The invention of claim 1, wherein the reactor chamber includes at least one inclined surface, the at least one inclined surface having a first portion and a second portion, the first portion being operably connected to the plurality of sidewalls, the at least one inclined surface having an inward inclination from the first portion toward the second portion, the second portion being operably connected to at least one of the at least one disposal opening.

6. The invention of claim 1, wherein the plurality of sidewalls is comprised of at least five sidewalls.

7. The invention of claim 1, wherein the plurality of sidewalls form a column.

8. The invention of claim 1 including at least one vent, the at least one vent operably connected to the reactor chamber, the at least one vent configured to allow the passage of process gas out of the reactor chamber.

9. The invention of claim 1 wherein the perforated liner is configured to prevent at least a portion of the plurality of process gas inlets from being occluded by the plurality of solid waste material adjacent to the perforated liner.

10. A gasification reactor comprising:

a. a top, a bottom, and a plurality of sidewalls, at least a portion of the plurality of sidewalls being operably connected to form a reactor chamber, the reactor chamber configured to receive and gasify a plurality of feed stock material;

b. at least one layer of insulative material, the at least one layer of insulative material being operably connected to the reactor chamber;

c. at least one burner, the at least one burner operably connected to the reactor chamber;

d. a perforated liner spaced inwardly from the plurality of sidewalls, wherein at least a portion of the perforated liner is configured to restrain at least a portion of the plurality of feed stock material away from the plurality of sidewalls;

e. a gas inlet operably connected to the reactor chamber configured to allow the flow of gasification process gas through the space between said perforated liner and said plurality of sidewalls;

f. at least one vent, the at least one vent operably connected to the reactor chamber, the at least one vent configured to allow the flow of process gas out of the reactor chamber;

g. at least one access loading door operably connected to the gasification reactor chamber; and h. at least one disposal opening operably connected to the gasification reactor chamber.

11. A gasification reactor chamber for the gasification of a plurality of feed stock material comprising:

a. a reactor chamber, the reactor chamber having a top, a bottom, and a plurality of sidewalls, the reactor chamber configured to receive and gasify the plurality of feed stock material;

b. at least one layer of insulative material, the at least one layer of insulative material operably connected to at least a portion of the plurality of sidewalls;

c. a process gas inlet operably connected to the reactor chamber, the process gas inlet configured to allow the flow of a gasification process gas into the reactor chamber;

d. a perforated grate operably positioned inside the reactor chamber;

e. a perforated liner operably positioned within the reactor chamber, the perforated liner configured to expose at least a portion of the surface of the plurality of feed stock material adjacent to the perforated liner to at least a portion of the gasification process gas, wherein at least a portion of the perforated liner is configured to restrain at least a portion of the plurality of feed stock material away from the plurality of sidewalls;

f. at least one access loading door operably connected to the reactor chamber;

g. at least one disposal opening operably connected to the reactor chamber; and h. at least one burner operably connected to the reactor chamber.

* * * * *